US011970924B2

(12) United States Patent
Tønnessen et al.

(10) Patent No.: US 11,970,924 B2
(45) Date of Patent: Apr. 30, 2024

(54) MODULARIZED SUBSEA COMPRESSOR TRAIN AND METHOD OF INSTALLATION

(71) Applicant: FMC Kongsberg Subsea AS, Kongsberg (NO)

(72) Inventors: Leif Arne Tønnessen, Bærums Verk (NO); Jan Helge Hassel, Røyken (NO); Mads Sørsdal, Drammen (NO)

( * ) Notice: Subject to any disclaimer, the term of this patent is extended or adjusted under 35 U.S.C. 154(b) by 0 days.

(21) Appl. No.: 17/914,348

(22) PCT Filed: Mar. 25, 2021

(86) PCT No.: PCT/EP2021/057751
§ 371 (c)(1),
(2) Date: Sep. 25, 2022

(87) PCT Pub. No.: WO2021/191354
PCT Pub. Date: Sep. 30, 2021

(65) Prior Publication Data

US 2023/0107601 A1 Apr. 6, 2023

(30) Foreign Application Priority Data

Mar. 26, 2020 (NO) ..... 20200357

(51) Int. Cl.
*E21B 43/01* (2006.01)
*F04D 17/14* (2006.01)
(Continued)

(52) U.S. Cl.
CPC ..... *E21B 43/01* (2013.01); *F04D 17/14* (2013.01); *F04D 25/0686* (2013.01); *F04D 25/16* (2013.01); *F04D 29/628* (2013.01)

(58) Field of Classification Search
CPC ..... E21B 43/01; E21B 43/36; E21B 41/0007; E21B 43/013; E21B 43/017; F04D 17/14;
(Continued)

(56) References Cited

U.S. PATENT DOCUMENTS

2007/0029091 A1* 2/2007 Stinessen ..... E21B 43/36 166/357
2009/0200035 A1* 8/2009 Bjerkreim ..... F17D 1/14 166/335
(Continued)

FOREIGN PATENT DOCUMENTS

NO 20151447 A1 11/2016
WO WO 96/06260 A1 2/1996
(Continued)

*Primary Examiner* — James G Sayre

(57) ABSTRACT

A subsea system includes a first foundation structure supporting a first compressor train and having a connection interface for connecting to a second foundation structure supporting an additional compressor train. The first compressor train includes a first compressor having an inlet connectable via a fluid line to a well flow line. A compressed fluid line having a flow regulation device is connected to an outlet of the first compressor and to a common outlet for compressed fluid. A first connection line is connected to the compressed fluid line at a position upstream of the flow regulation device, and a third connection line is connected to the fluid line at a position upstream of the first compressor. Each of the first and third connection lines includes a flow regulating device and is configured to connect to the additional compressor train. A second connection line is connected to the compressed fluid line at a position downstream of the flow regulation device and is configured to connect to the additional compressor train to thereby connect the additional compressor train to the common outlet.

19 Claims, 17 Drawing Sheets

(51) Int. Cl.
*F04D 25/06* (2006.01)
*F04D 25/16* (2006.01)
*F04D 29/62* (2006.01)

(58) Field of Classification Search
CPC .... F04D 25/0686; F04D 25/16; F04D 29/628; F04D 27/0215; F04D 27/0269; F04D 29/624; F04D 29/644; F04D 29/601; F04B 41/06; F05D 2230/51; F05D 2240/91
See application file for complete search history.

(56) References Cited

U.S. PATENT DOCUMENTS

| | | | |
|---|---|---|---|
| 2012/0118008 | A1 | 5/2012 | Dam et al. |
| 2015/0104328 | A1 | 4/2015 | Babbitt et al. |
| 2015/0184490 | A1 | 7/2015 | Kanstad |
| 2017/0159421 | A1 | 6/2017 | Sillapacharn et al. |
| 2019/0360313 | A1 | 11/2019 | Ellingsen et al. |

FOREIGN PATENT DOCUMENTS

| | | | |
|---|---|---|---|
| WO | WO 2019/076580 | A1 | 4/2019 |
| WO | WO 2019/209119 | A1 | 10/2019 |
| WO | WO 2020/002215 | A1 | 1/2020 |

* cited by examiner

MODULARIZED SUBSEA COMPRESSOR TRAIN AND METHOD OF INSTALLATION

FIELD OF THE INVENTION

The present invention relates to a method of installing a subsea system comprising at least one compressor train. In addition, the invention relates to a subsea system comprising at least one compressor train.

In particular, the present invention relates to a method of operating a subsea system receiving a well flow stream from at least one upstream flowline and supplying the well flow stream to at least one downstream flowline at an increased pressure, where the compression capacity can be regulated during the lifetime of a field.

BACKGROUND OF THE INVENTION

Gas handling is defined as one of the most important future business areas the oil and gas industry. As the undisputedly most efficient method to recover gas from subsea gas reservoirs, subsea compression plays a major role in the operator's gas handling strategy. To date two different subsea compression systems have been installed, one being Gullfaks SGC and the other Åsgard SGC. Both systems have two compressor trains at a common foundation. At Åsgard the second compressor train was installed on the same foundation structure as the first compressor train and put into operation one year after the first compressor train. The initial set foundation structure at Åsgard was therefore set with space for two compressor trains initially. However, both first and second installations consist of identical elements (inlet cooler, scrubber, compressor, pump and outlet cooler). A compression system designed for phased installation would today typically be similar to Åsgard, with a common foundation structure and with compression elements added at time of need or, alternatively, it would consist of several smaller compressor stations installed at different time and connected by spools at the seafloor.

The concept with common foundation structure is constrained by the following drawbacks:

- The foundation structure and manifold module must be sized for a fixed number of compressor trains, with little flexibility to add compressors if a need is identified in late field life,
- Early investment in a large foundation structure made for x number of compressor trains is required, even though fewer trains are required in early operation,
- A large foundation structure and manifold module may require installation by an expensive heavy lift vessel.

The concept with multiple smaller compressor stations is constrained by the following drawbacks:

- Time-consuming and costly installation and hook-up of system with multiple foundation structures and spools.
- Spools at the seabed used for interconnection of the templates are typically installed liquid filled. These spools, because they tend to rest on the seabed, also constitute low-points/liquid traps in the system and will accumulate liquid (produced or condensed) during standstill because the liquid in the system will flow towards the lowest points. System startup is challenging, especially for wellstream compression systems (no pumps) which are sensitive to amount of liquid at compressor inlet.
- Such system will typically have a manifold which serves as a connection hub for the compressor trains, and is sized for a pre-defined number of trains.

It is therefore a need to address the drawbacks related to the prior art solutions.

One of the objectives of the invention is to provide a cost-effective subsea solution where the compressor capacity can be increased during lifetime of the field, and where the investment related to added compression capacity is delayed to the time of need.

SUMMARY OF INVENTION

The invention is set forth in the independent claims, while the dependent claims describe other characteristics of the invention.

The invention provides a solution which delays the investment cost to the time of need and thereby improves the economy in the project (Net Present Value and Internal Rate of Return). Initially, a first compressor train comprising a flow conditioning unit, a compressor unit, a cooler and connection lines for subsequent second, third, . . . , xth compressor trains is installed. Then, as the reservoir is depleted and the pressure in the reservoir decreases, or if the well flow characteristics change and there is an increased demand of pressure assistance, additional compressor trains can be connected to the already installed compressor train(s). Therefore, according to the invention, as the need of compression may increase during lifetime of a field, a second (and possible additional) compressor train can be installed when required, by connecting this compressor train to the already installed compressor train(s). In order to simplify and ease installation as well as reducing cost, this second (and possible additional) compressor train does not have a dedicated flow conditioning unit. Instead of a flow conditioning unit, the second compressor train is either connected to an outlet of the first compressor via the connection lines (compressor trains in series), or alternatively, to an outlet of the flow conditioning unit of the initial compressor train via the connector lines (compressor trains in parallel).

Using relatively short horizontal spools between manifolds (e.g. piping) of the different compressor trains, it is possible to drain all liquid either to the inlet flowline or, more preferably, to the outlet flowline. If draining to inlet flowline, and the system comprises a flow conditioning unit, all of the drained liquid will enter the flow conditioning unit which will handle the liquid upstream the compressor(s).

The invention relates to a method of installing a subsea system comprising the steps of:

- installing at least one first foundation structure on a seabed, wherein the first foundation structure comprises a connection interface connectable to a second foundation structure,
- installing a first compressor train on the foundation structure, the first compressor train comprising at least a first compressor,
- connecting the first compressor train to at least one well flow line,
- connecting a first compressed fluid line to an outlet of the first compressor and to a common outlet for the compressed fluid in the subsea system, wherein the first compressed fluid line comprises a flow regulating device,
- connecting a first connection line to the first compressed fluid line at a position upstream of the flow regulating device and/or to a line at a position upstream of the first compressor, and wherein the first connection line is connectable to an additional compressor train positioned on the second foundation structure, the first connection line comprising a flow regulation device, connecting a second connection line to the first compressed fluid line at a position downstream of the flow regulation device and wherein the second connection line is connectable to the additional compressor train, the second connection line comprising a flow regulation device.

Each compressor train has at least one branch or connection line leading to the next compressor train and one connection line for receiving return fluid from the next compressor train.

The line at the position upstream of the first compressor can be the well flow line or a line from a flow conditioning unit. When using this line, parallel connection of the compressor trains can be obtained.

The first compressor train may be the only compressor train installed on the first foundation structure. In this example, the additional compressor train installed on the second foundation structure is a second compressor train. If two compressor trains are installed on the second foundation structure, these compressor trains are the second compressor train and the third compressor train, respectively.

Alternatively, the first compressor train and a second compressor train may be installed on the first foundation structure. In this example, the additional compressor train installed on the second foundation structure is a third compressor train. If two compressor trains are installed on the second foundation structure, these compressor trains are the third compressor train and the fourth compressor train, respectively.

One or more of first, second and/or third connection lines may either be connected separately to a subsequent compressor train, or they may be adjoined upstream of the connection to the subsequent compressor train.

The foundation structure for the "next compressor train" may be hung off in a connection interface on the foundation structure for the "previous compressor train". Levelling and foundation elements will then only be required on the opposite side of the new foundation structure. The second foundation structure may comprise a complementary connection interface on the second foundation structure which mates with the connection interface of the first foundation structure. When connected, the connection interface and the complementary connection interface form a pivot connection between the first and second foundation structures such that the second foundation structure can be pivoted relative the first foundation structure and which supports the second foundation structure when positioned on the seabed. The connection between the connection interface and the complementary connection interface may be a hinged connection, a pivotally/pivotable joint or other suitable connections performing the required pivotability when connected.

The first installation, which comprises the first foundation structure and one or more compressor trains, shall preferably be arranged with all necessary arrangements for conditioning of the incoming hydrocarbon stream with respect to temperature-management (inlet cooler) and stabilization of liquid transients (Flow Conditioning Unit—FCU) if required. Any requirements for routing of flow between multiple inlet and outlet flowlines is preferably done in the first installation.

If a FCU is present, and in the event of high liquid/gas ratio, the liquid outlet of the FCU (in case of an FCU with separate liquid outlet) can be connected to a pump. If a pump is used, liquid will normally be pumped directly to the export field-flowline (i.e. the common outlet for the subsea system), and only gas will be routed to the next compressor train(s). The next compressor train(s) shall boost any flow coming from the compressed fluid line of the previous compressor train(s) without any further conditioning before entering the compressor(s) of the next compressor train(s). As such, all installations (i.e. second, third fourth, . . . , nth installation) after the first installation can be of similar and simplified design. It is also possible to design a system with both pump and feature(s) for injecting liquid into compressors (either via separate liquid lines or lines with a gas liquid mixture). Such system may enable boosting of liquid (by compressor) even in case the pump is not operating. Such system also enables compressor washing by process fluid in case of compressor fouling.

The common foundation structures supporting the different compressor trains of all installations are mechanically connected in the same plane (preferably in the horizontal or mainly horizontal plane) next to each other on the seabed. This facilitates interconnection of manifolds/piping of the different compressor trains and manifolds either by short horizontal spools or by skidding (i.e. horizontal movement) the components of the different compressor trains or manifolds into connection with each other avoiding spools resting on the seabed forming liquid traps. Skidding may be the preferred connection method if only 2 foundation structures shall be used. Spools may be the preferred connection method for a system that may be expanded to more than 2 foundation structures. If spools are used, they should preferably have a U-shape in the horizontal plane to obtain flexibility and drainage between compression trains.

The foundation elements supporting the foundation structures on the seabed can be mudmat(s), pile(s) or suction anchor(s), or combinations thereof. If using mudmat(s), the mudmat(s) are preferably connected to the foundation structure topside such that the foundation structure and mudmat(s) are installed together in one run. The same operation applies if using suction anchor(s) instead of mudmat(s) as foundation element(s). However, it is also possible to install the mudmat(s) or suction anchor(s) in one run, and thereafter install the foundation structure supported by the mudmat(s) or suction anchor(s).

A "next compressor train", which could be the $2^{nd}$ train, $3^{rd}$ train, . . . nth train are connected to the "previous compressor train" (n-1) and will boost either the low pressure flow branched off from upstream the previous compressor or the high pressure flow branched off from downstream the (optional) previous discharge cooler (i.e. the previous compressed fluid line). As such the "next compressor train" can operate in series to or in parallel with the "previous compressor train(s)". The discharge of each compressor train can either be routed to the next compressor train for further boosting or back through the previous compressor train(s) into the well flow line. It is envisaged that all "next compressor trains" are of identical design (possibly except for compressor aerodynamic bundle in series operation).

For each train, all separate retrievable modules may be connected directly to the manifold, either by horizontal skidding or vertical connections.

The process system of the "next compressor train" may be coupled to the "previous compressor train(s)" via the manifolds. Manifolds can be interconnected by skidding or by use of short spools, avoiding any pipe elements on the seafloor. This will allow any liquid in each of the compressor trains to be drained to the well flow line (or the common outlet for the subsea system) prior to start. With interconnecting spools at seafloor any liquid would accumulate in these spools and cause startup-challenges of the compressors.

The method may further comprise a step of connecting a flow conditioning unit to the at least one well flow line upstream of the inlet of the first compressor.

The flow conditioning unit may:

1) have a separation functionality possibly combined with a slug catcher functionality (with a liquid hold up volume) with at least one outlet for lighter fluid and at least one outlet for heavier fluid,
2) have a slug catcher functionality (with a liquid hold up volume) with at least one outlet for commingled lighter and heavier fluid.

A flow conditioning unit may not be needed if gas flow is relatively dry and without liquid slugs or surges.

The method may further comprise the steps of:

connecting at least a first outlet of the flow conditioning unit to the inlet of the first compressor via at least one fluid line.

The method may further comprise the steps of:

connecting a first cooler upstream and/or downstream of the first compressor. The cooler may be upstream of the first compressor, but more preferably downstream of the first compressor either in the first compressed fluid line or in the common outlet for the subsea system, or possibly one cooler may be upstream of the first compressor and another cooler may be arranged downstream of the first compressor. In simplest form, cooling in and out of the subsea system (i.e. cooling of the well flow entering the subsea system and cooling of the flow exiting through the common outlet) shall primary be performed on the first installation, while necessary cooling internally for each compressor train (anti-surge) and cooling between the compressor trains (in series) shall be integrated in the design of each of the compressor trains.

One possible solution is to have a combined outlet/anti-surge cooler (anti-surge=recycle) at each compressor train. In series operation the outlet cooler of train n will then act as inlet cooler to train n+1. In case of high gas temperature at wellstream entering the first compressor train an additional inlet cooler may be placed at the inlet of the first compressor train upstream the branch-off to the next compressor train (and thereby provide cooled gas to all compressors in parallel operation).

The method may further comprise a step of:

starting up production using at least the first compressor train.

The method may further comprise a step of:

determining a need for increased compression capacity.

The method may further comprise the steps of:

installing a second foundation structure for supporting an additional compressor train on the seabed, connecting the second foundation structure to the first foundation structure via the connection interface on the first foundation structure and a complementary connection interface on the second foundation structure, the first and second foundation structures forming a common foundation structure, installing the second compressor train on the common foundation structure such that the additional compressor train is supported partly by the first and second foundation structures, connecting the additional compressor train to the first compressor train via at least the first connection line and the second connection line, wherein the additional compressor train comprises a compressor.

The second compressor train may, if required, comprise a second cooler. In addition, the second compressor train may comprise a connection interface connectable to a third foundation structure.

The method may further comprise moving or skidding components forming part of the subsea system into position relative each other on the common foundation structure.

The method may further comprise installing a second compressor train on the first foundation structure.

The method may further comprise:

connecting the connection interface and the complementary connection interface to form a pivot connection between the first and second foundation structures, such that the second foundation structure can be pivoted relative the first foundation structure and wherein the pivot connection supports the second foundation structure when positioned on the seabed.

The method may further comprise the steps of:

installing a third foundation structure for supporting the third compressor train on the seabed, wherein the third foundation structure comprises a connection interface connectable to a fourth foundation structure, installing the third compressor train partly on the third foundation structure and partly on the second foundation structure such that the second compressor train is supported partly by the second and third foundation structures, connecting the third compressor train to the second compressor train via at least the first connection line and the second connection line, wherein the third compressor train comprises a third compressor. The third compressor train may, if required, comprise a third cooler.

The connection of the second compressor train, i.e. the additional compressor train, may comprise, in order to arrange the first and second compressor trains in series, the steps of:

operating the flow regulation device in the first compressed fluid line to a closed position, connecting a second compressed fluid line to an outlet of the second compressor and to a common outlet for the compressed fluid in the subsea system, wherein the second compressed fluid line comprises a flow regulating device, connecting the first connection line to an inlet of the second compressor and opening the flow regulation device in the first connection line to allow fluids from the first compressed fluid line to enter the second compressor, connecting the second connection line to the outlet of the second compressor and opening the flow regulation device in the second connection line, wherein the second connection line is connected to the common outlet for the compressed fluid in the subsea system.

The connection of the second compressor train, i.e. the additional compressor train, may further comprise, in order to arrange the first and second compressor trains in parallel, the steps of:

operating the flow regulation device in the first fluid connection line to a closed position and the flow regulation device in the compressed fluid line to an open position, connecting the at least one well flow line to an inlet of the second compressor via the third connection line and operating the flow regulating device in the third connection line to an open position to allow fluids to enter the second compressor, connecting the second connection line to an outlet of the second compressor and operating the flow regulation device in the second connection line to an open position, wherein the second connection line is connected to the common outlet for the compressed fluid in the subsea system.

The method may further comprise:

connecting the outlet of the flow conditioning unit to an inlet of the second compressor via at fluid line and the third connection line.

Each of the foundation structures may comprise one common manifold for all of the compressor train(s) on that foundation structure. For example, if the first foundation structure only has one compressor train, i.e. the first compressor train, installed thereon, the manifold serves this one compressor train. In another example, if there are two compressor trains, i.e. the first and a second compressor train, installed on the first foundation structure, the manifold is common or shared by both of these compressor trains. Similarly, if the second foundation structure only has one compressor train installed thereon, the manifold is dedicated for this one compressor train. In another example, if two compressor trains are installed on the second foundation structure, the manifold is common or shared by both of these compressor trains.

The skilled person will understand that the flow conditioning unit may comprise two or more outlets arranged next to each other for connection to the fluid lines leading to the first and second compressors to ensure similar flow characteristics in the different fluid lines. This may be done by connecting separate gas and liquid lines to each new compressor train, with a valve device, so that liquid is injected in a controlled manner into the gas line directly upstream each compressor. A second alternative is to have one common outlet for lighter and heavier fluid lines from the flow conditioning unit where the common outlets are connected to a pipe with two or more branch connection lines (such as Y or T connections or even more branches). A third alternative is to have one sole outlet from the FCU, where mixing of gas and liquid is performed internally in the FCU, and where mixed gas and liquid exits through the same sole outlet. A flow regulation device can be arranged in the sole outlet, which flow regulation device can be operated to adjust the amount of mixed gas exiting the FCU and entering the compressor(s).

Although each compressor train has one branch or connection line leading to the next compressor train and one connection line for receiving return fluids from the next compressor train, the first compressor phase may account for and prepare the possibility of connecting more branches later during the lifetime of the field. The branch(es) not used in the first compressor train may then be provided with a valve device which is closed until the second, or any additional compressor train(s), is installed.

When these second or additional compressor trains is installed, the valve device is opened allowing fluid to flow through the branch to compressor(s) in later installation phases. For example, in parallel operation with two compressors, two valves in the heavier fluid line shall be controlled to 50% flow in both liquid lines. In case of three compressors, one valve in the heavier fluid line leading to the first compressor is controlled to ⅓ liquid flow, while the other valve in the heavier fluid line leading to the second and third compressors are controlled to ⅔ liquid flow. Any T-branches in the line at second train shall ensure that liquid/gas mixture is equal in each branch. Each train shall preferably have a T-branch so that the same flow-spilt functionality is maintained if a next compressor train is connected. A third alternative is to install a pump at the first compressor train pumping liquid directly from the FCU (or scrubber) to the common outlet of the system. In this solution, dry gas (or almost dry gas) flows from the first compressor train to the next compressor train(s).

It is further described a subsea system comprising:

a first foundation structure on a seabed, the first foundation structure comprises a connection interface connectable to a second foundation structure;

a first compressor train supported by the first foundation structure, the first compressor train comprising a first compressor with an inlet which is connectable to a well flow line;

a compressed fluid line connected to an outlet of the first compressor and to a common outlet for compressed fluid in the subsea system, wherein the compressed fluid line comprises a flow regulation device;

a first connection line connected to the compressed fluid line at a position upstream the flow regulation device and/or to a line at a position upstream of the first compressor, and wherein the first connection line is connectable to an additional compressor train positioned on the second foundation structure, the first connection line comprising a flow regulation device;

a second connection line connected to the compressed fluid line at a position downstream of the flow regulation device and wherein the second connection line is connectable to the additional compressor train positioned on the second foundation structure, the second connection line comprising a flow regulation device.

Similarly as for the method, the first compressor train may be the only compressor train installed on the first foundation structure. In this example, the additional compressor train installed on the second foundation structure is a second compressor train. If two compressor trains are installed on the second foundation structure, these compressor trains are the second compressor train and the third compressor train, respectively.

Alternatively, the first compressor train and a second compressor train may be installed on the first foundation structure. In this example, the additional compressor train installed on the second foundation structure is a third compressor train. If two compressor trains are installed on the second foundation structure, these compressor trains are the third compressor train and the fourth compressor train, respectively.

The first compressor train may comprise a flow conditioning unit connected to the well flow line, and the flow conditioning unit may comprise at least a first outlet connectable to the inlet of the first compressor via at least one fluid line.

The line at the position upstream of the first compressor can be the well flow line or a line from a flow conditioning unit. When using this line, parallel connection of the compressor trains can be obtained.

The subsea system may comprise a first cooler upstream and/or downstream of the first compressor. The cooler may be upstream of the first compressor, but more preferably downstream of the first compressor either in the first compressed fluid line or in the common outlet for the subsea system (or both).

The subsea system may further comprise:

a second foundation structure connected to the first foundation structure via the connection interface and a complementary connection interface on the second foundation, the first and second foundation structures forming a common foundation structure positioned on the seabed;

an additional compressor train installed on the common foundation structure, such that the additional compressor train is supported partly by the first and second foundation structures;

the additional compressor train comprises a compressor, wherein the compressor comprises an inlet and an outlet where the inlet is connected to the first connection line and the outlet is connected to a second compressed fluid line;

the second compressed fluid line is connected to the common outlet for compressed fluid in the subsea system via the second connection line.

The additional compressor train, i.e. the second compressor train, may comprise a second cooler. The second cooler is preferably arranged in the second compressed fluid line.

In an aspect, the components required for the second and any later foundation structures and compressor trains are identical.

In an aspect, the subsea system further comprises other necessary equipment for operating components of the subsea system, wherein said equipment is located at the same foundation structure as the compressor train it shall operate, such as e.g. power equipment for operating the first compressor can be located on the first foundation structure.

At least some of the components forming part of the subsea system may be movable or skiddable on the common foundation structure, such that the subsea components can be arranged closed relative each other.

The subsea system may further comprise:

a second foundation structure connected to the first foundation structure via the connection interface forming a common foundation structure positioned on the seabed;

a second compressor train installed on the common foundation structure, such that the second compressor train is supported partly by the first and second foundation structures;

the second compressor train comprises a second compressor, wherein the second compressor comprises an inlet and an outlet where the inlet is connected to the first connection line and the outlet is connected to a second compressed fluid line;

the second compressed fluid line is connected to the common outlet for compressed fluid in the subsea system via the second connection line.

In an aspect of the subsea system, the fluid line connecting the at least first outlet with the first compressor may comprise a first recycle line recycling fluids through the first compressor, and wherein the first recycle line may comprise a first anti-surge valve.

It is obvious that instead of a subsea system comprising compressor trains, the setup described herein will be appropriate for a subsea system comprising pump trains. The components forming part of such a subsea system with pump trains will be similar as the ones described herein (except for the more compressor and pump specific components).

Summarized, the method and system according to the invention described herein have the following main benefits:

a. Minimized investment-cost for an operative subsea compression system b. Subsea compression system can be expanded at the time in field-life when added boosting is required.

i. Investment follows the same timeline as the need. Early pre-investment for a later need is avoided ii. Compressor characteristic is selected close in time to the need, meaning that the required duty points are well defined with less risk for mistakes.

c. It is not critical that the reservoir development is accurately predicted at the time of first compression investment, because the system can be adapted to the actual reservoir development throughout the field life d. All the above can be accomplished with use of standardized building-blocks, in a compact arrangement, and connections can be done without need of interconnecting spools at seafloor. Such spools increase installation time—and adds operational challenges concerning drainage and liquid-accumulation in spools, which again incur increased cost.

In addition, the long spools between a first and second compressor train of prior art solutions are superfluous because the foundation structures are connected directly to each other forming a common foundation structure. As such, the different compressor trains are supported on the common foundation structure meaning that the different compressor trains will not move relative each other. This results in that smaller spools or direct pipelines can be used for connecting up the compressor trains.

These and other embodiments of the present invention will be apparent from the attached drawings, where:

DETAILED DESCRIPTION OF A PREFERENTIAL FORM OF EMBODIMENT

Figure 1:
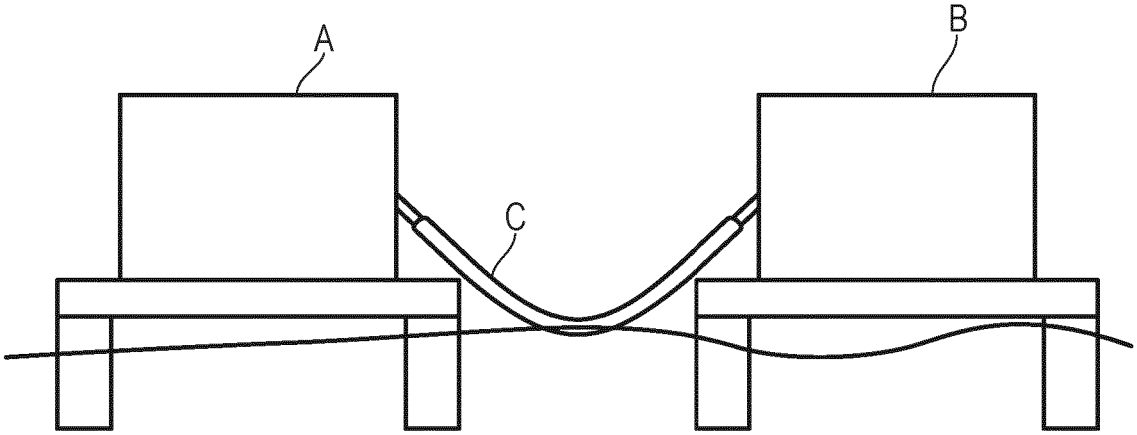
FIG. 1 (Prior Art)
FIG. 1 shows an example of a prior art subsea system with a spool between components of the subsea system, and where the shape of the spool serves as a liquid trap.

In the following, embodiments of the invention will be discussed in more detail with reference to the appended drawings. It should be understood, however, that the drawings are not intended to limit the invention to the subject-matter depicted in the drawings. Furthermore, even though some of the features are described in relation to the subsea system only, it is apparent that they are valid for the related method as well, and vice versa. Hence, any features described in relation to the method are also valid for the subsea system.

Furthermore, in the following specific description, reference is made to a first connection line, a second connection line and a third connection line. The first connection line (10',10",10'") is described in relation to series operation of compressor trains, while the second connection line (11', 11", 11'") is the same return line both for series and parallel operation of the compressor trains, and the third connection line (12',12",12'") is described in relation to parallel operation of the compressor trains.

It is clear that in simplest form, the subsea system only requires either:

1) in case of series operation of compressor trains: the first connection line (10',10",10'") and the second connection line (11', 11", 11'"), or
2) in case of parallel operation of the compressor trains: the third connection line (12',12",12'") and the second connection line (11', 11", 11'"), or
3) to enable the possibility of series and parallel operation at a later stage, both points 1) and 2) above.

FIG. 1 shows an example of a prior art subsea system with a spool C between the first and second subsea components A, B of the subsea system, and where the shape of the spool C serves as a liquid trap (liquid indicated by solid part of spool C). Such spools C, if resting on the seabed, will be the lowest points of the subsea flow systems and consequently serve as liquid traps because the liquid flows to the lowest points by means of gravity. Thus, produced liquid and condensed liquid (during stand-still) will collect in these spools, and during start-up after stand-still or before production start, this collected liquid will enter the compressor as one liquid plug with a risk of damaging the compressor due to too high liquid ratio.

Figure 2A:
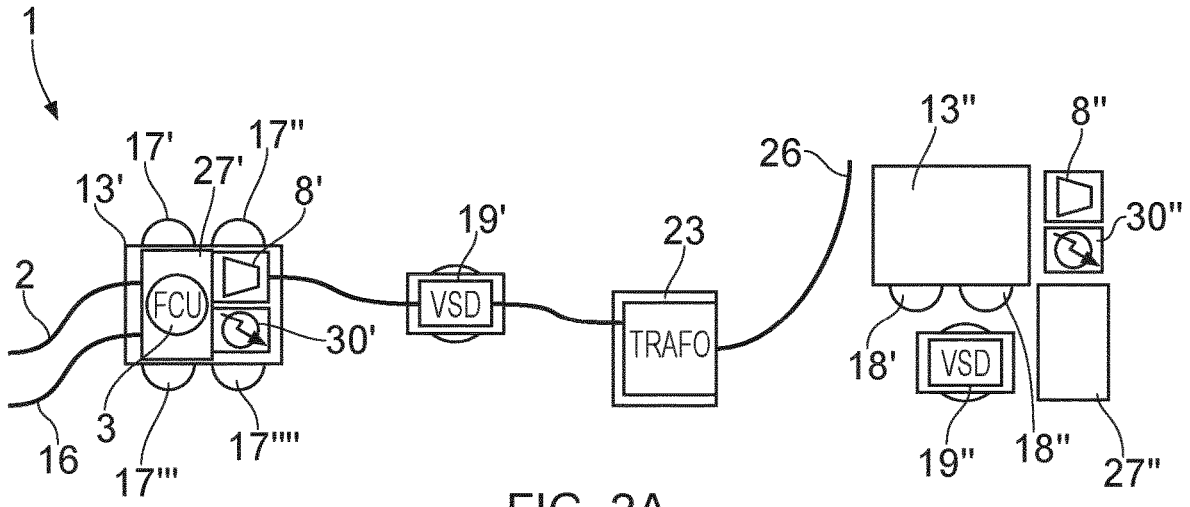
FIGS. 2A-2F show a typical installation sequence according to the present invention.

In FIG. 2A installation of first compressor train in a subsea system 1 is complete. The first compressor train is mounted on a foundation structure 13'. The foundation structure 13' is supported on four foundation elements 17',17",17'",17"" (the foundation elements for first foundation structure can be mudmat, piles, suction anchors or a combination of these). The disclosed subsea system 1 comprises a first compressor train comprising a flow conditioning unit (FCU) 3. Well flow enters the flow conditioning unit 3 through a well flow line 2 connected to required pipes 27' for the first compressor train. Compressed well flow with a higher pressure than the pressure of the well flow in the well flow line 2 exits the first compressor train through a common outlet 16 for the compressed fluid in the subsea system. The subsea system 1 further comprises a first compressor 8' connected to the flow conditioning unit 3, a first cooler 30' connected to an outlet of the first compressor 8', wherein the first cooler 30' is connected to the common outlet 16 for the compressed fluid in the subsea system. Required power to drive the first compressor 8' (and possibly other electrically driven components of the subsea system) are submitted via electric cable 26 connected to a transformer 23 (which is a passive electrical device that transfers electrical energy from one electrical circuit to one or more circuits) and a first variable speed drive 19' (which is a device used to control the speed of the first compressor 8').

On the right-hand side in FIG. 2A the components forming part of the second compressor train are shown with the components separated from each other. The disclosed components include a second foundation structure 13", two additional foundation elements 18', 18" for supporting the second foundation structure 13", a second compressor 8", a second cooler 30" and required pipes indicated by element 27".

Figure 2B:
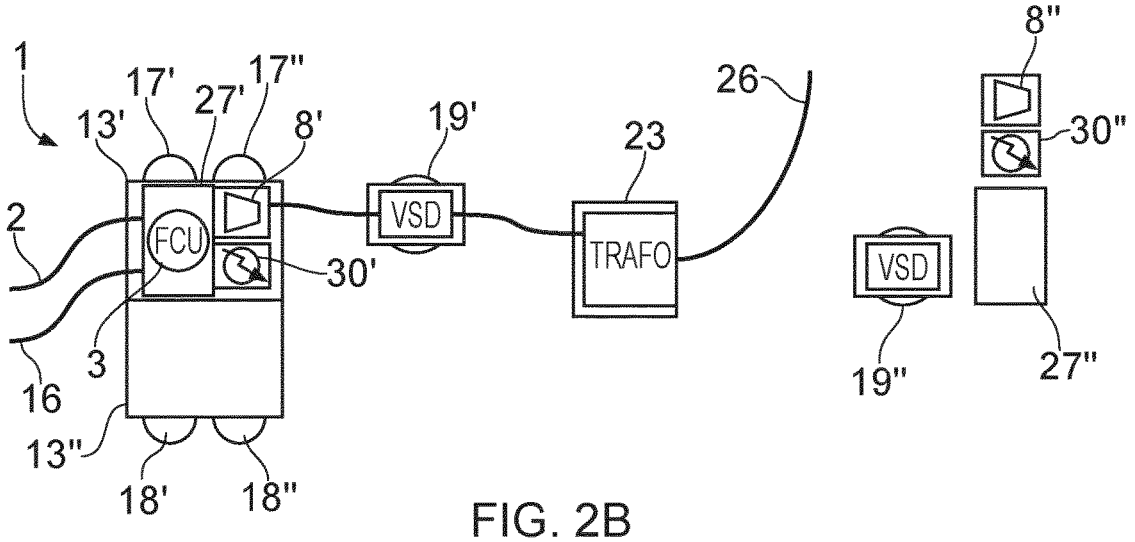

In FIG. 2B shows start of installation of the second compressor train. A second foundation structure 13" supported on two additional foundation elements 18',18" are partly supported on two of the foundation elements 17'", 17'" (not shown in FIG. 2B) used in supporting the first foundation structure 13' and on two additional foundation elements 18', 18" installed in connection with the installation of the second compressor train. The second foundation structure 13" can be levelled relative the first foundation structure 13' by raising or lowering the foundation elements 18', 18" (the foundation elements 18', 18" can be mudmat, piles or a combination of these).

Figure 2C:
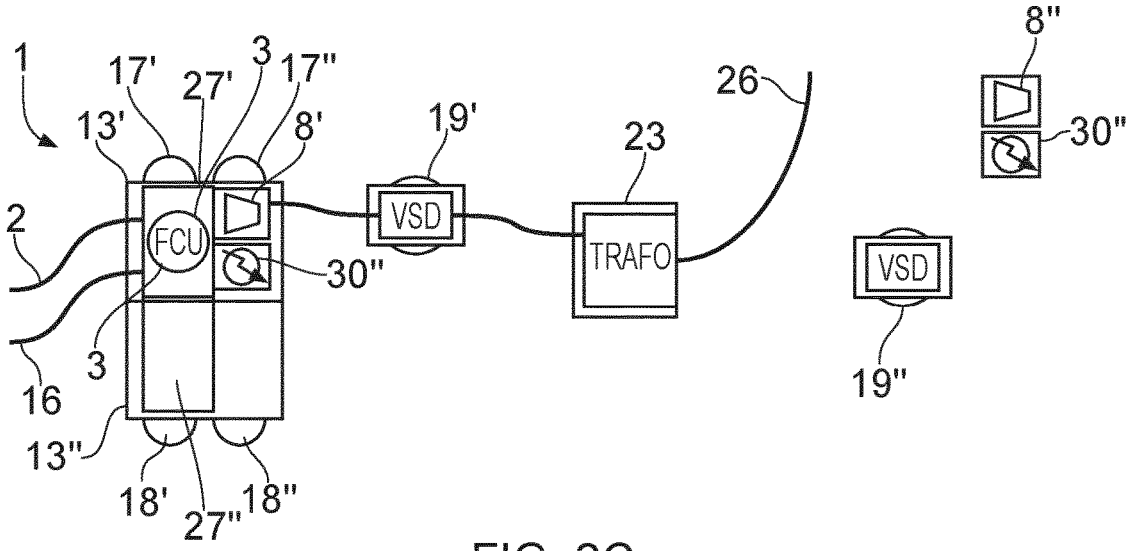

In FIG. 2C installation of required pipes 27" to the second compressor train, including first and second connection lines 10',11' (although not shown in FIG. 2C), has been done.

Figure 2D:
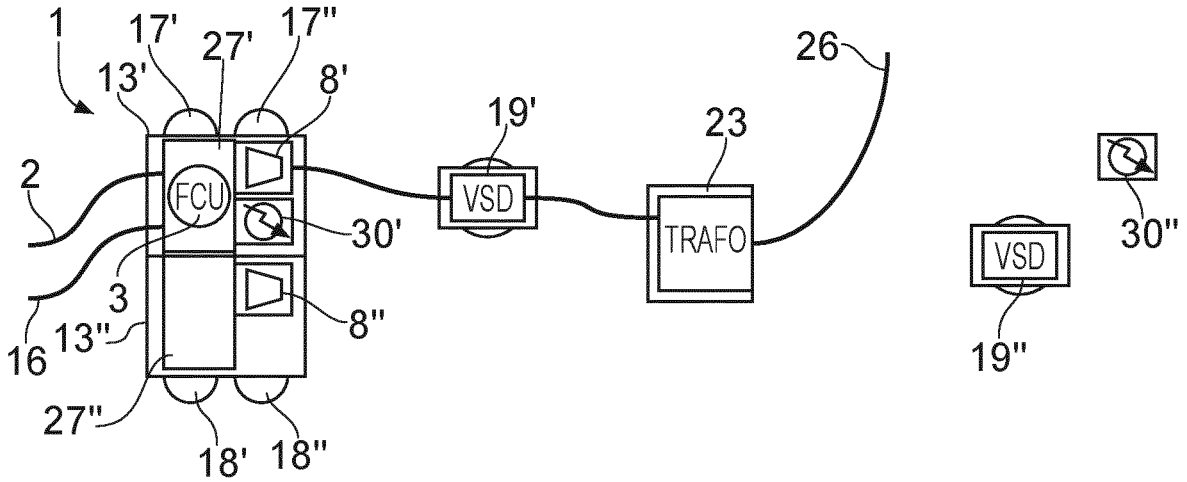

In FIG. 2D the installation of the second compressor train continues, including installing the second compressor 8" on the second foundation structure 13".

Figure 2E:
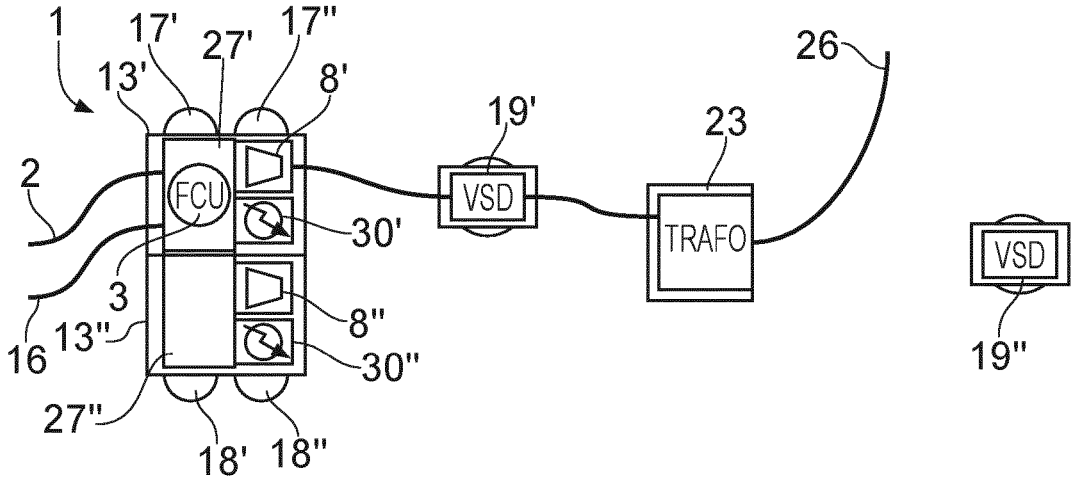

In FIG. 2E the installation of the second compressor train continues, where a second cooler 30" is installed on the second foundation structure 13".

Figure 2F:
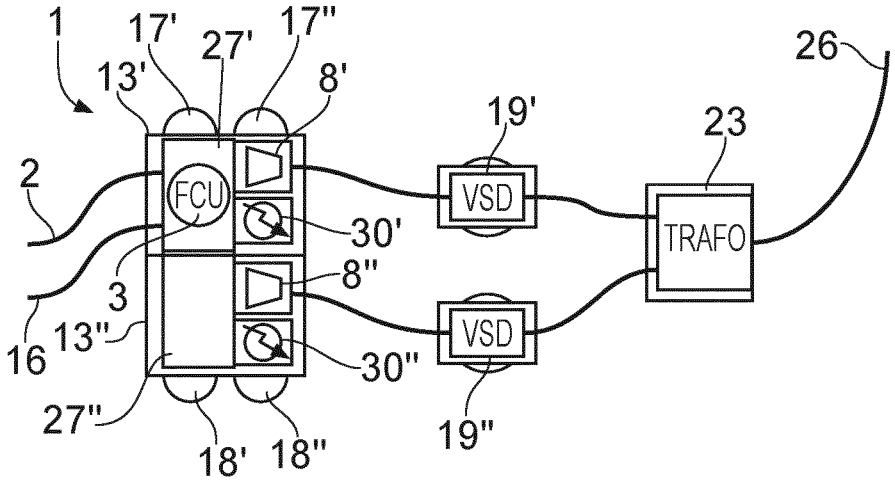

In FIG. 2F the installation of the second compressor train continues, a second variable speed drive 19" is connected to the transformer 23 and the second compressor 8". As is clear from FIG. 2F, a common transformer 23 is used for the first and second variable speed drives 19', 19" as well as a common electric cable 26. Furthermore, the second compressor train utilizes the same flow conditioning unit 3, as well as the same well flow line 2 and the same common outlet 16 for the compressed fluid in the subsea system. The installation of the second compressor train, whether in series or in parallel connection with the first compressor train, is now complete once all the required pipes 27" between the different components have been connected.

The second compressor train is preferably prepared for connection with a third compressor train in the event even further compression is required during the lifetime of the field. The installation of a third, and possibly an additional fourth, fifth, sixth, . . . , tenth) compressor trains, is performed similarly as described with reference to FIGS. 2A-2F and will not be further described herein. Such third and additional compressor trains will also preferable take advantage of the common components installed during the installation of the first compressor train, i.e. the flow conditioning unit 3, the transformer 23, the electric cable 26 and the connections to the well flow line 2 and common outlet 16 for the compressed fluid in the subsea system.

Figure 2G:
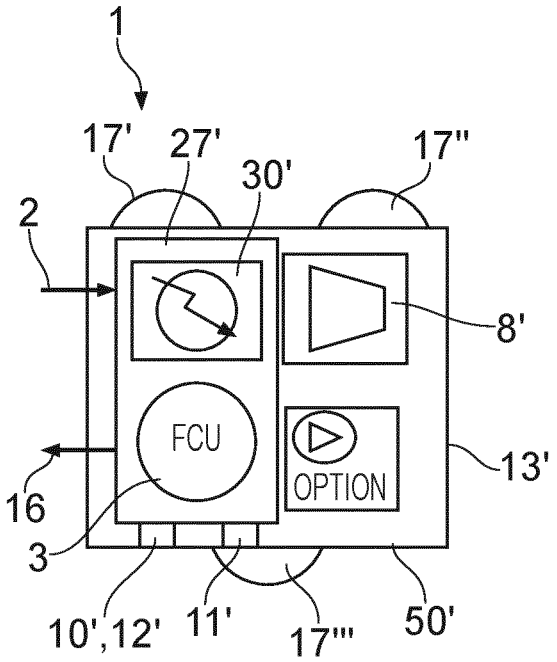
FIGS. 2G-2J show different examples of modular components which may form part of the first foundation structure and the second foundation structure.
Figure 2H:
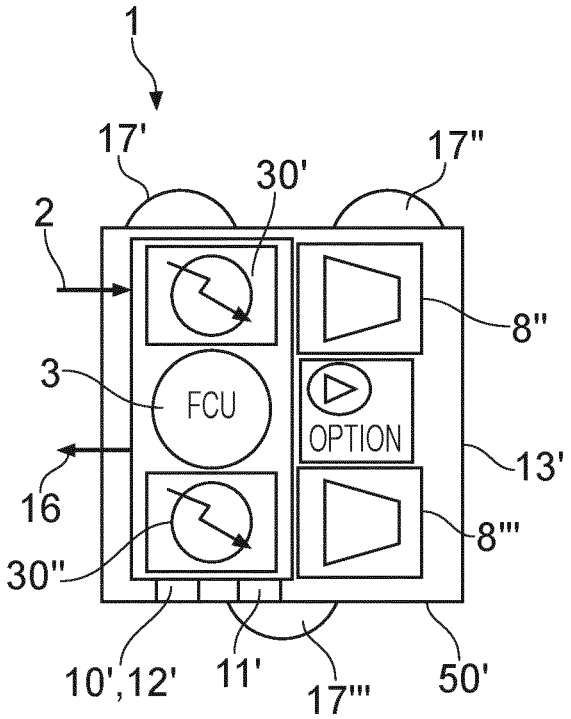

FIGS. 2G-2J show different examples of modular components which may form part of the first foundation structure 13' and the second foundation structure 13". The modular components in FIGS. 2G and 2H are examples of standard modular first foundation structures 13' which can be stand-alone subsea systems 1 or be connected to any of the examples of second foundation structures 13" disclosed in FIGS. 2I and 2J.

In particular, the subsea system 1 in FIG. 2G shows the first foundation structure 13' with the first compressor train 8' installed thereon. The foundation structure 13' is supported on three foundation elements 17',17",17'". The disclosed subsea system 1 comprises a first compressor train 8' comprising a flow conditioning unit (FCU) 3. Well flow enters the flow conditioning unit 3 through a well flow line 2 connected to required pipes for the first compressor train (referred to as reference number 27'). Compressed well flow with a higher pressure than the pressure of the well flow in the well flow line 2 exits the first compressor train through a common outlet 16 for the compressed fluid in the subsea system. The subsea system 1 further comprises a first compressor 8' connected to the flow conditioning unit 3, a first cooler 30' connected to an outlet of the first compressor 8', wherein the first cooler 30' is connected to the common outlet 16 for the compressed fluid in the subsea system. The system in FIG. 2G may have similar power setup as described in relation to FIG. 2A. The first foundation structure 13' is disclosed with a connection interface 50' for connection to a complementary connection interface 51' (not shown in FIG. 2G, see FIG. 2I).

The main difference between the first foundation structures 13' in FIGS. 2G and 2H is that the first foundation structure 13' in FIG. 2G has one compressor train 8, while the first foundation structure 13' in FIG. 2H has two compressor trains 8', 8".

Figure 2I:
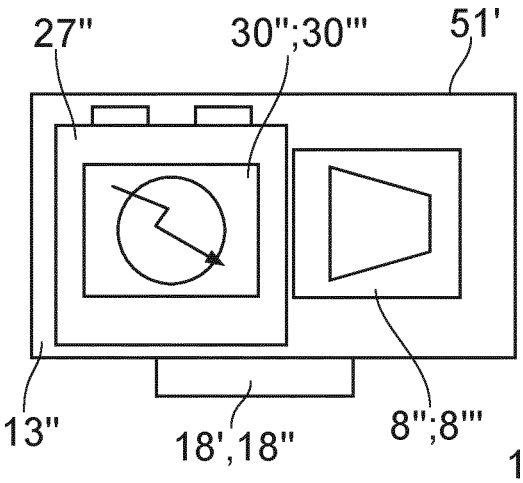
Figure 2J:
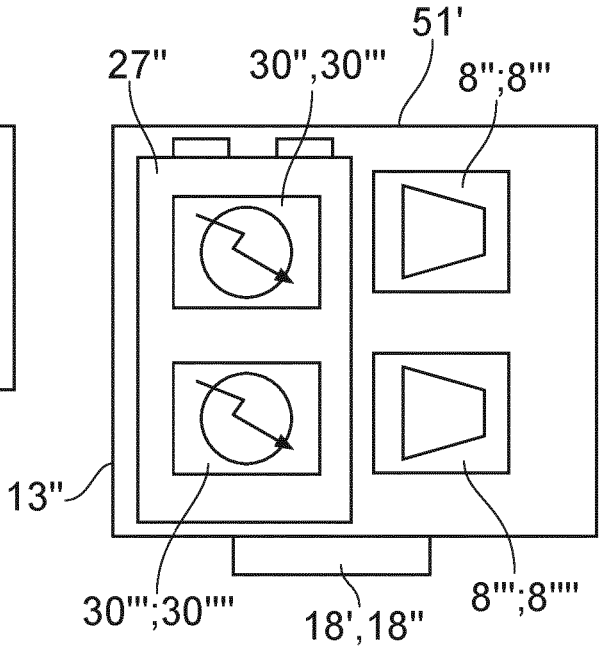

FIGS. 2I and 2J are examples of modular second foundation structures 13" connectable to the first foundation structure 13' in FIG. 2G or 2H.

The second foundation structures 13" comprises a complementary connection interface 51' for connection to the connection interface 50' on the first foundation structure 13' and required pipes for each compressor train (referred to as reference number 27"). The difference between the second foundation structures 13" in FIGS. 2I and 2J being that the second foundation structure 13" in FIG. 2I comprises one compressor train 8";8'" whereas the second foundation structure 13" in FIG. 2J comprises two compressor trains 8";8'" and 8'";8"". The different denotations of the compressor trains 8";8'" and 8'";8"" on the second subsea structure 13" is dependent on the whether there is one or two compressor trains 8',8" on the first foundation structure 13'. Similarly, the different denotations of the coolers 30";30'" and 30'"; 30"" on the second subsea structure 13" is dependent on the whether there is one or two coolers 30',30" on the first foundation structure 13'.

Figure 2K:
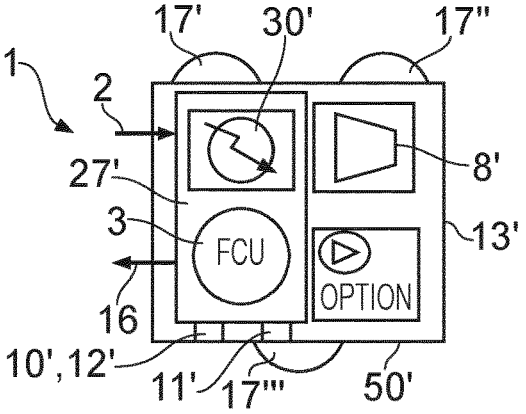
FIGS. 2K-2P show six different combinations of the modular components in FIGS. 2G-2J.
Figure 2N:
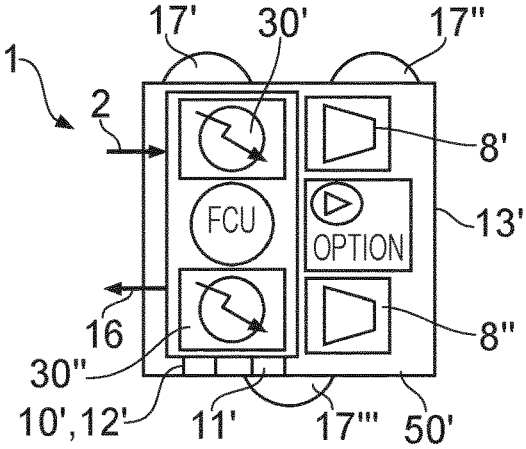
Figure 2L:
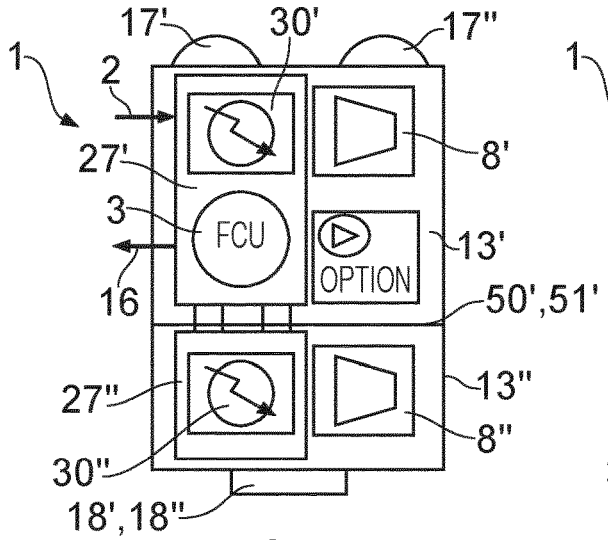
Figure 2O:
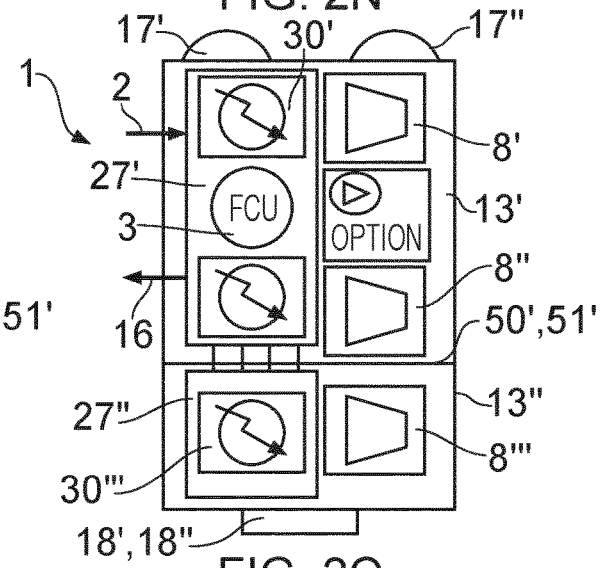
Figure 2M:
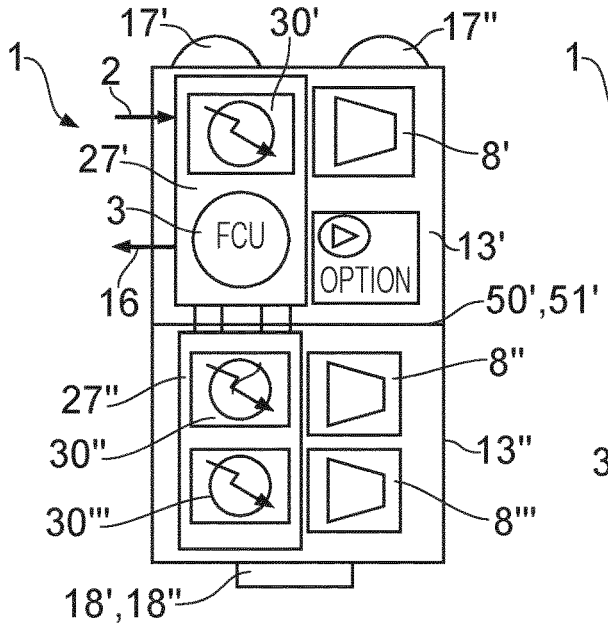
Figure 2P:
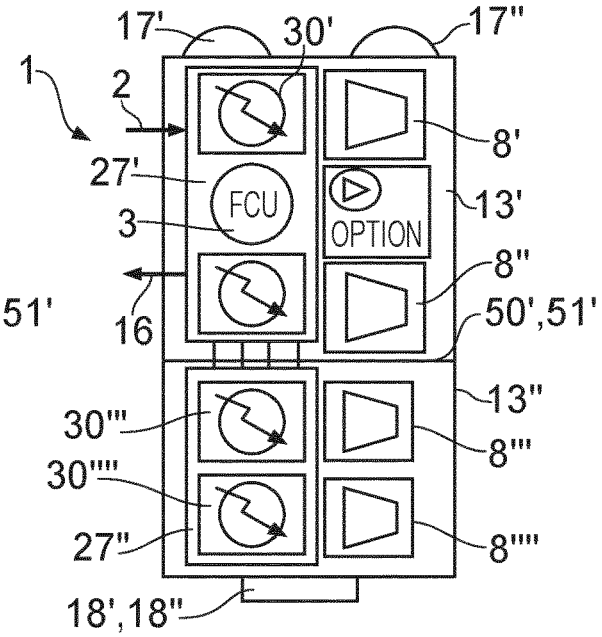

FIGS. 2K-2P show six different combinations of the modular components in FIGS. 2G-2J, where FIGS. 2K, 2L and 2M show examples of a subsea system 1 with one compressor train, i.e. a first compressor train 8', on the first foundation structure 13', and FIGS. 2N, 2O and 2P show examples of a subsea system 1 with two compressor trains, i.e. a first and a second compressor train 8', 8", on the first foundation structure 13'.

In particular, FIG. 2K shows the first foundation structure 13' with the first compressor train 8' installed thereon with similar features as the subsea system 1 in FIG. 2G.

FIG. 2L is a subsea system 1 formed by combining the first foundation structure 13' in FIG. 2G and the second foundation structure 13" with one compressor train 8" in FIG. 2I.

FIG. 2M is a subsea system 1 formed by combining the first foundation structure 13' in FIG. 2G and the second foundation structure 13" with two compressor trains 8",8'" in FIG. 2J.

FIG. 2N shows the first foundation structure 13' with the first and second compressor trains 8',8" installed thereon with similar features as the subsea system 1 in FIG. 2H.

FIG. 2O is a subsea system 1 formed by combining the first foundation structure 13' in FIG. 2H and the second foundation structure 13" with one compressor train 8'" in FIG. 2I.

FIG. 2P is a subsea system 1 formed by combining the first foundation structure 13' in FIG. 2H and the second foundation structure 13" with two compressor trains 8'",8"" in FIG. 2J.

Figure 3:
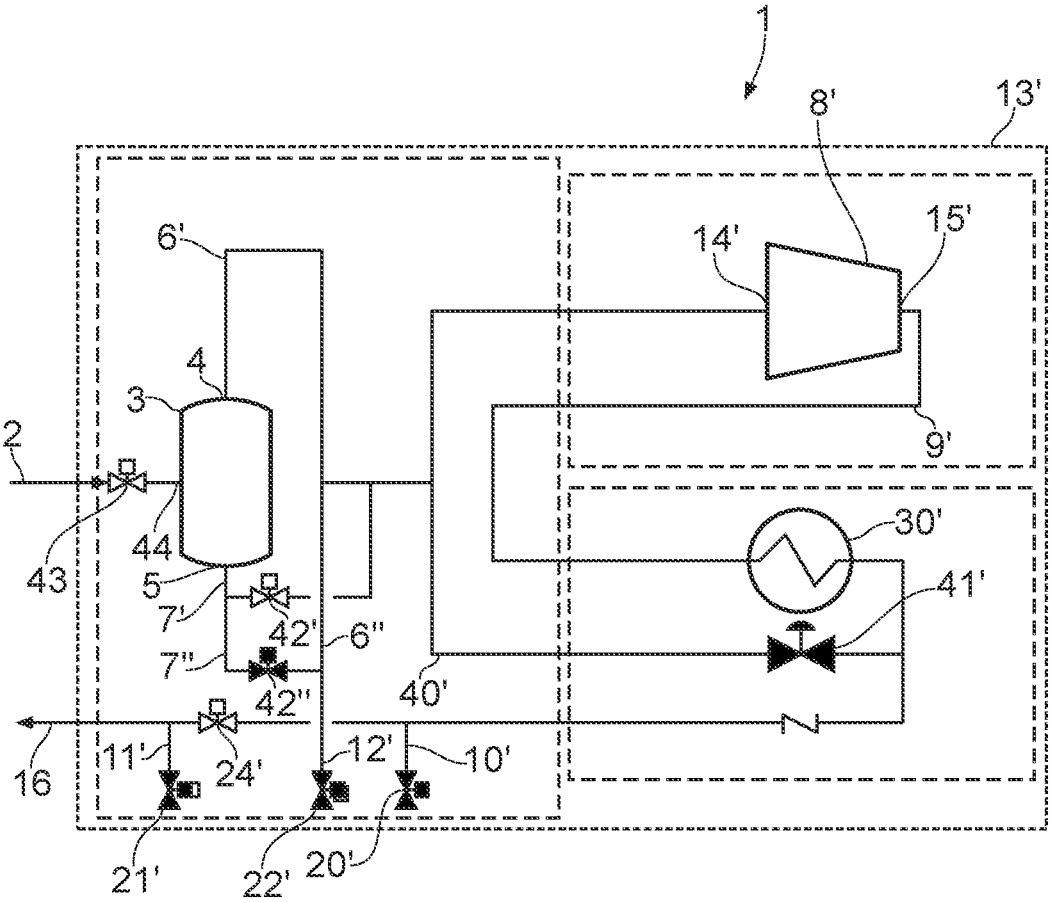
FIG. 3 shows an example of the components forming part of the first compressor train after the first compressor train has been installed.

FIG. 3 shows an overview of the components forming part of the first compressor train of the subsea system 1 after the first compressor train has been installed. The setup in FIG. 3 is the same regardless of whether the next compressor train shall be arranged in a series connection or a parallel connection with the first compressor train. The first compressor train is supported by a first foundation structure 13'. Hydrocarbon fluids from e.g. a subsea well enter the flow conditioning unit 3 through well flow line 2. A flow regulation device 43 is arranged in the well flow line 2 upstream of an inlet 44 of the flow conditioning unit 3. The flow conditioning unit 3 comprises a first outlet 4 for lighter fluids connected to a fluid line 6' for lighter fluids, which fluid line 6' is connected to an inlet 14' of a first compressor 8' in a second end. The flow conditioning unit 3 further comprising a second outlet 5 for heavier fluids connected to a fluid line 7' for heavier fluids, which fluid line 7' comprises a flow regulation device 42' and which is connected to the fluid line 6' for lighter fluids upstream of the inlet 14' to the first compressor 8'. Instead of connecting the fluid line 7' for heavier fluids to the fluid line 6' for lighter fluids it is possible to connect the fluid line 7' for heavier fluids directly to the inlet of the first compressor 14'. A first compressed fluid line 9' is connected to an outlet 15' of the first compressor 8' in one end thereof and to a common outlet 16 for the compressed fluid in the subsea system 1 in a second end thereof. The first compressed fluid line 9' comprises a first cooler 30'. It is further disclosed a first recycle line 40' with a first anti-surge valve 41' recycling fluids from the first compressed fluid line 9' downstream of the first cooler 30' to the fluid line 6' upstream of the first compressor 8'. The purpose of the recycle line(s) is to ensure that there is always sufficient flow through the compressor to avoid compressor-surge, even when there is little flow in the well flow line 2. The principle of the flow conditioning unit disclosed in FIG. 3 is described in Norwegian patent document NO 341968 B, which content is incorporated herein. The flow conditioning unit 3 further comprising an additional fluid line 6" for lighter fluids from the first outlet 4 of the flow conditioning unit 3 and an additional fluid line 7" for heavier fluids from the second outlet 5. The fluid line 7" comprises a flow regulation device 42" and is connected to the fluid line 6" for lighter fluids upstream of the inlet 14" to the second compressor 8".

It is further disclosed a (third) connection line 12' connected to the fluid line 6" for parallel connection of the first compressor train with the second compressor train. The third connection line 12' comprises a flow regulation device 22'.

The compressed fluid line comprises a flow regulation device 24' downstream of the first cooler 30' and the connection to the first recycle line 40'. A first connection line 10' for connecting the first compressor train with the second compressor train is connected to the first compressed fluid line 9' upstream of the flow regulation device 24' and downstream of the first cooler 30' and the connection to the first recycle line 40'. The first connection line 10' comprises a flow regulation device 20' which is closed when no additional compressor trains are connected. A second connection line 11' for connecting the first compressor train with the second compressor train is connected to the first compressed fluid line 9' downstream of the flow regulation device 24' and upstream of the common outlet 16 for the compressed fluid in the subsea system 1. The second connection line 11' comprises a flow regulation device 21' which is closed when no additional compressor trains are connected.

Figure 4:
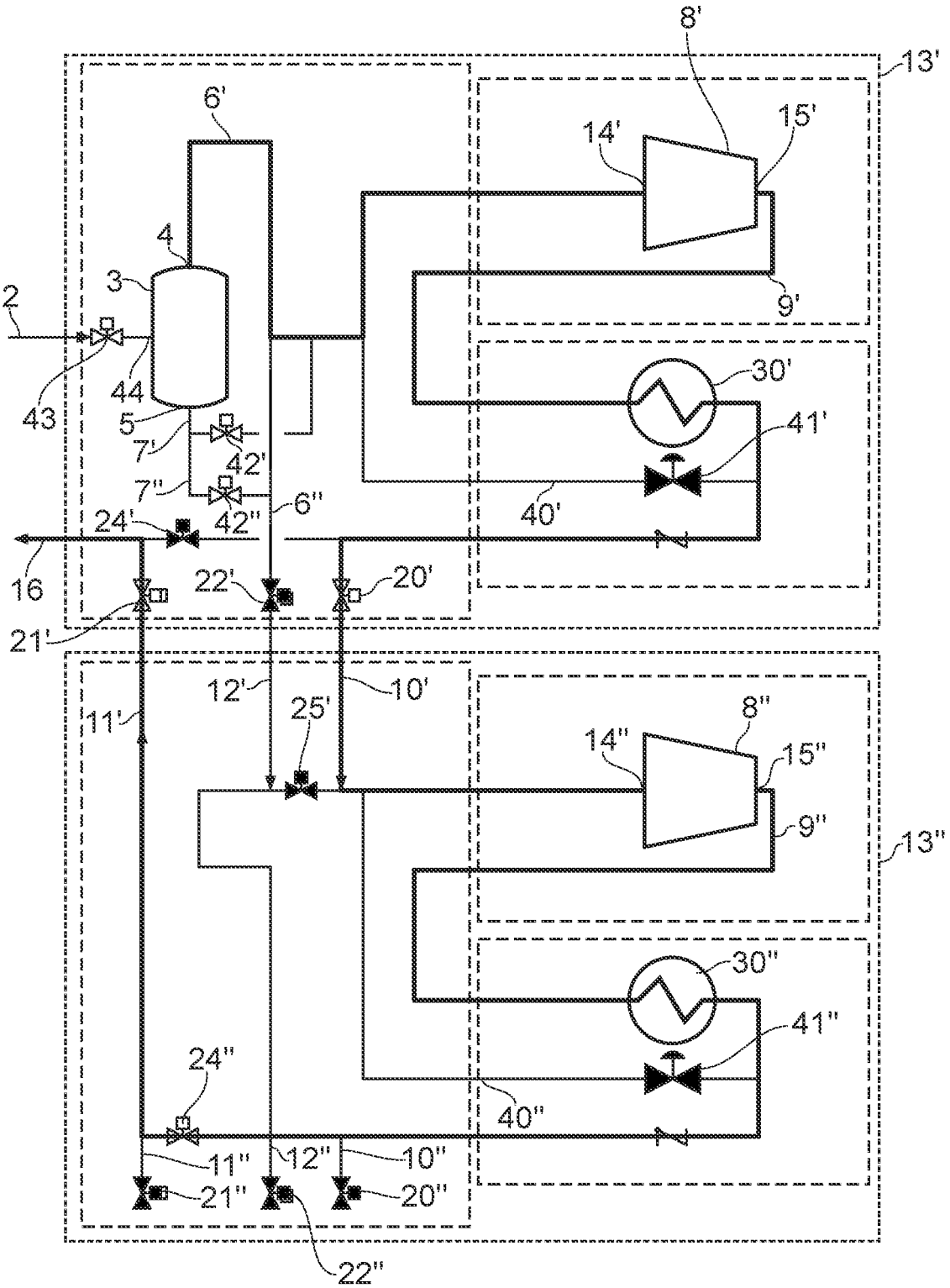
FIG. 4 shows an exemplary setup of two compressor trains in series after the first and second compressor trains have been installed.

FIG. 4 shows an exemplary setup of two compressor trains in series after the first and second compressor trains have been installed. The components of the first compressor train are similar to the components described in relation to FIG. 3 and will not be repeated herein. The second compressor train is supported partly by the first foundation structure 13' and partly by the second foundation structure 13". The inlet 14" of the second compressor 8" is connected to the first connection line 10' connected to the first compressed fluid line 9' in the first compressor train.

A second compressed fluid line 9" is connected to an outlet 15" of the second compressor 8" in one end thereof and to a common outlet 16 for the compressed fluid in the subsea system 1 in a second end thereof. The second compressed fluid line 9" comprises a second cooler 30". A second recycle line 40" with a second recycle valve 41" (regulated type) ensuring a minimum allowed flow in the second compressor 8" and the second cooler 30" extends from first connection line 10' upstream of the second compressor 8" to the second compressed fluid line 9" downstream of the second cooler 30". The second compressed fluid line 9" comprises a flow regulation device 24" downstream of the second cooler 30" and the connection to the second recycle line 40". A first connection line 10" for connecting the second compressor train with a third compressor train is connected to the second compressed fluid line 9" upstream of the flow regulation device 24" and downstream of the second cooler 30" and the connection to the second recycle line 40". The first connection line 10" comprises a flow regulation device 20" which is closed when no additional compressor trains are connected. A second connection line 11" for connecting the second compressor train with a third compressor train is connected to the second compressed fluid line 9" downstream of the flow regulation device 24" and upstream of the common outlet 16 for the compressed fluid in the subsea system 1. The second connection line 11" comprises a flow regulation device 21" which is closed when no additional compressor trains are connected.

In order to ensure that the same well fluid is compressed both in the first compressor 8' in the first compressor train and the second compressor 8" in the second compressor train, the flow regulation device 24' in the first compressed fluid line 9' is closed such that compressed well fluids in the first compressed fluid line 9' is directed to the inlet 14" of the second compressor 8' (except any fluid directed through the first and/or second recycle line 40', 40") and exit the subsea system through the common outlet 16.

Series operation of the first and second compressors 8', 8" in the first and second compressor trains, respectively, can be achieved by operating the following valves to be in a closed or an open position:

- flow regulation device 24' in the first compressed fluid line 9' is closed,
- flow regulation device 20' in the first connection line 10' is open,
- flow regulation device 25' is closed
- flow regulation device 24" in the second compressed fluid line 9" is open,
- flow regulation device 21' in second connection line 11' is open.

The flow regulation devices 42', 42" in the fluid lines 7',7" for heavier fluids may be open or closed dependent on the characteristics of the fluid from the well flow.

The fluid flow through the first compressor train and further through the second compressor train is indicated by the thick solid line in FIG. 4.

Figure 5A:
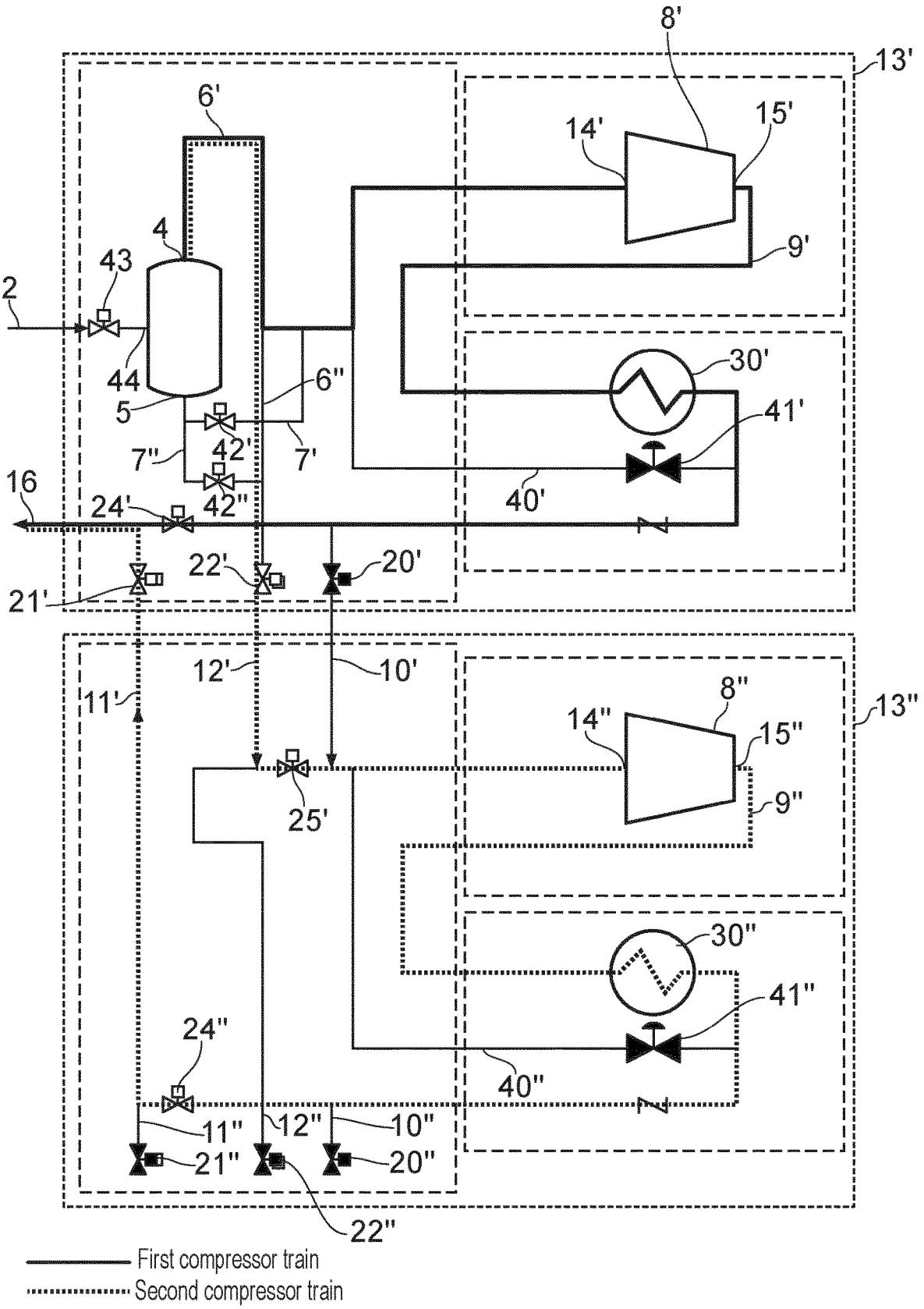
FIG. 5A shows an exemplary setup of two compressor trains in parallel after the first and second compressor train have been installed.

FIG. 5A shows an exemplary setup of two compressor trains in parallel after the first and second compressor train have been installed. The components forming part of the first and second compressor trains are similar to the setup described with reference to FIGS. 3 and 4.

Parallel operation of the first and second compressors 8', 8" in the first and second compressor trains, respectively, can be achieved by operating the following valves to be in a closed or an open position:

- flow regulation device 24' in the first compressed fluid line 9' is open,
- flow regulation device 20' in the first connection line 10' is closed,
- flow regulation device 22' in the third connection line 12' is open,
- flow regulation device 25' upstream of the inlet 14' to the second compressor 8" is open,
- flow regulation device 24" in the second compressed fluid line 9" is open, and
- flow regulation device 21' in second connection line 11' is open,
- flow regulation device 20" in the first connection line 10" is closed,
- flow regulation device 21" in the second connection line 11" is closed,
- flow regulation device 22" in the third connection line 12" is closed.

The fluid flow through the first compressor train is indicated by the thick solid line in FIG. 5A. The fluid flow through the second compressor train is indicated by the dashed line in FIG. 5A.

Figure 5B:
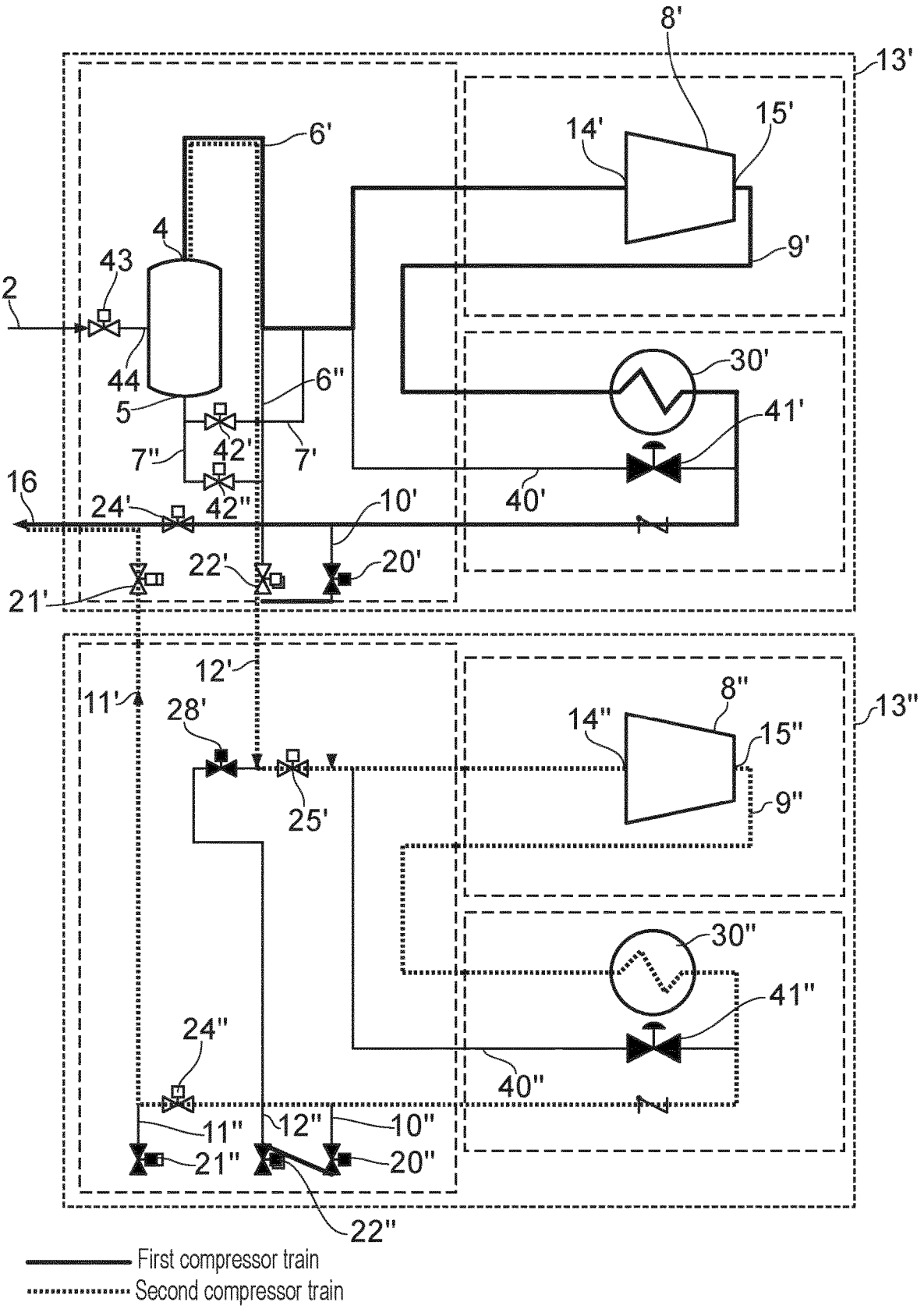
FIG. 5B shows an alternative exemplary setup compared to the solution in FIG. 5A of two compressor trains in parallel after the first and second compressor train have been installed.

FIG. 5B shows an alternative exemplary setup compared to the solution in FIG. 5A of two compressor trains in parallel after the first and second compressor train have been installed. The only difference between the solution in FIG. 5B compared to FIG. 5A is that there are fewer connection lines between the first compressor train and the second compressor train, as well as between the second compressor train and the third compressor train. This is achieved by connecting the first connection line 10', 10" to the third connection line 12',12" downstream of the flow regulation device 22', 22" in the third connection line 12',12". An additional flow regulation device 28' is arranged in the inlet line to the second compressor 8" on the opposite of the connection point of the first connection line 10' compared to the flow regulation device 25'. In the setup in FIG. 5B, the same third fluid line 12', 12" can be used both for series and parallel operation of the first and second compressor trains.

Figure 6:
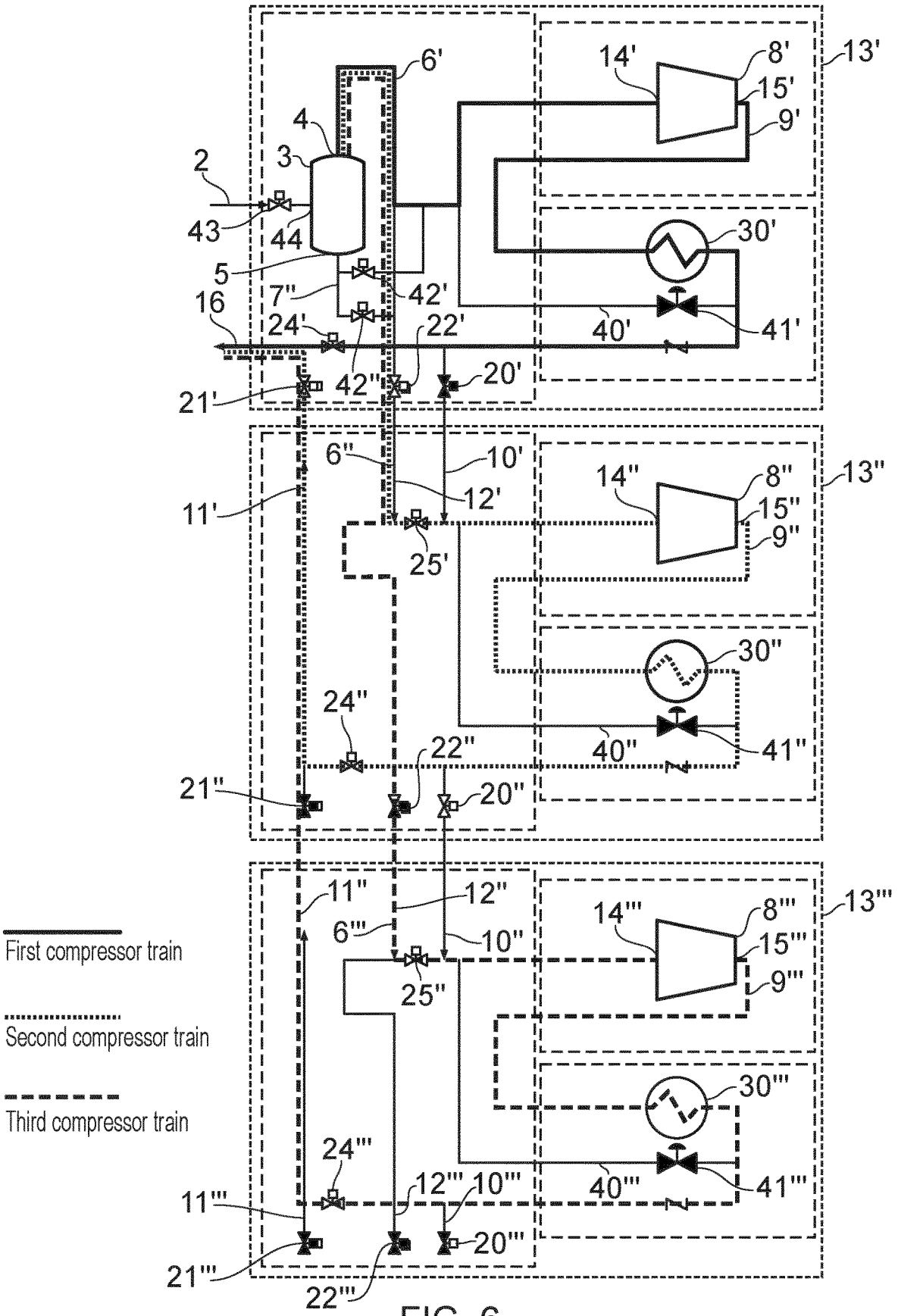
FIG. 6 shows an exemplary setup of three compressor trains in parallel after the first, second and third compressor train have been installed.

FIG. 6 shows an exemplary setup of three compressor trains in parallel after the first, second and third compressor train have been installed. The second compressor train 13" is supported partly by the first foundation structure 13' and partly by the second foundation structure 13". The third compressor train is supported partly by the second foundation structure 13' and partly by the third foundation structure 13'".

A third compressed fluid line 9'" is connected to an outlet 15'" of the third compressor 8'" in one end thereof and to a common outlet 16 for the compressed fluid in the subsea system 1 in a second end thereof. The third compressed fluid line 9'" comprises a third cooler 30'". A third recycle line 40'" with a third recycle valve 41'" ensuring a minimum allowed flow in the third compressor 8'" and the third cooler 30'" extends from first connection line 10" upstream of the third compressor 8'" to the third compressed fluid line 9'" downstream of the third cooler 30'". The third compressed fluid line 9'" comprises a flow regulation device 24'" downstream of the third cooler 30'" and the connection to the third recycle line 40'". A first connection line 10'" for connecting the third compressor train with a fourth compressor train is connected to the third compressed fluid line 9'" upstream of the flow regulation device 24'" and downstream of the third cooler 30'" and the connection to the third recycle line 40'". The first connection line 10'" comprises a flow regulation device 20'" which is closed when no additional compressor trains are connected. A second connection line 11'" for connecting the third compressor train with a fourth compressor train is connected to the third compressed fluid line 9'" downstream of the flow regulation device 24'" and upstream of the common outlet 16 for the compressed fluid in the subsea system 1. The second connection line 11'" comprises a flow regulation device 21'" which is closed when no additional compressor trains are connected. A third connection line 12'" for connecting the third compressor train with a fourth compressor train is connected to the fluid line 6'" for lighter fluids. The third connection line 12'" comprises a flow regulation device 22'" which is closed when no additional compressor trains are connected.

The remaining components forming part of the first and second compressor trains are similar to the setup described with reference to FIGS. 3, 4 and 5, except that there are additionally:

- a third compressor 8'" and a third cooler 30'",
- fluid lines 6'", 7'" for lighter fluids and heavier fluids, respectively, from the outlets 4,5 of the flow conditioning unit 3,
- a third connection line 12'" connected to the fluid line 6'" for lighter fluids for connecting the first compressor train with the fourth compressor train, the third connection line 12'" comprises a flow regulation device 22'",
- a flow regulation device 25" upstream of the inlet 14'" of the third compressor 8'" at a position between the first and third connection lines' 10", 12" connection to the inlet 14'" of the third compressor 8'".

Parallel operation of the first, second and third compressors 8', 8", 8'" in the first, second and third compressor trains, respectively, can be achieved by operating the following valves to be in a closed or an open position:

- flow regulation device 24' in the first compressed fluid line 9' is open,
- flow regulation device 20' in the first connection line 10' is closed,
- flow regulation device 22' in the third connection line 12' is open,
- flow regulation device 25' upstream of the inlet 14' to the second compressor 8" is open,
- flow regulation device 24" in the second compressed fluid line 9" is open, and
- flow regulation device 21' in second connection line 11' is open,
- flow regulation device 20" in first connection line 10" is closed,
- flow regulation device 21" in second connection line 11" is open,
- flow regulation device 22" in third connection line 12" is open,
- flow regulation device 25" upstream of the inlet 14' to the third compressor 8" is open,
- flow regulation device 24'" in third compressed fluid line 9'" is open,
- flow regulation device 20'" in the first connection line 10'" is closed,
- flow regulation device 21'" in the second connection line 11'" is closed,
- flow regulation device 22'" in the third connection line 12'" is closed.

The fluid flow through the first compressor train is indicated by the thick solid line in FIG. 6. The fluid flow through the second compressor train is indicated by the relatively shorter dashed line in FIG. 6. The fluid flow through the third compressor train is indicated by the relatively longer dashed line in FIG. 6.

Figure 7:
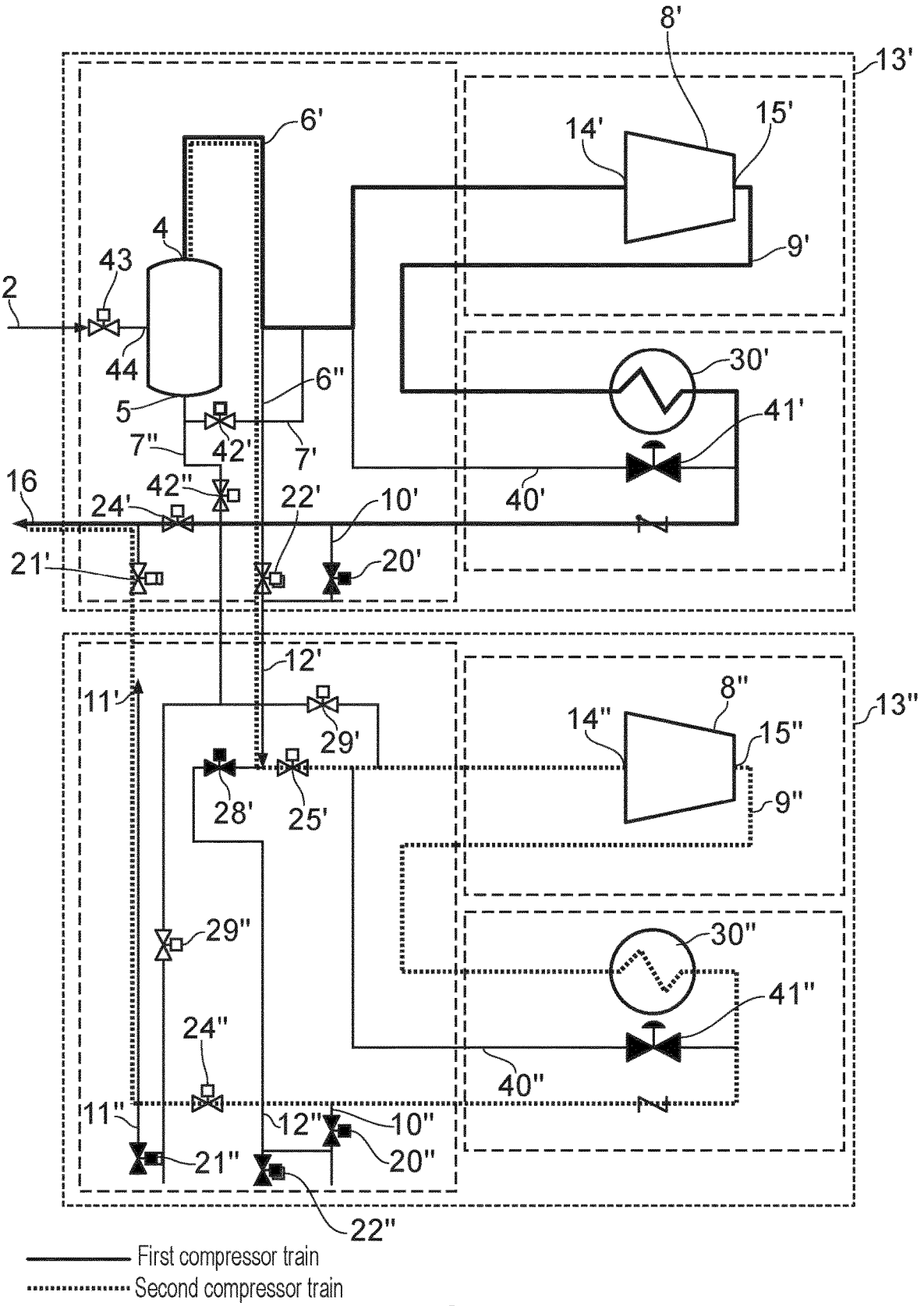
FIG. 7 shows an exemplary embodiment where gas and liquid (water, oil and or condensate) are fed to the compressor trains in separate pipes based on the example setup in FIG. 5B.

FIG. 7 shows an exemplary embodiment where gas and liquid (water, oil and/or condensate) are fed to the compressor trains in separate pipes based on the example setup in FIG. 5B. The fluid line 7" for heavier liquids forms a fourth connection line and splits at the second compressor train. Flow regulation devices 29', 29" are arranged in heavy fluid line 7" connected to the inlet line upstream of second compressor 8" and in the fourth connection line connected to subsequent compressor trains.

Figure 8A:
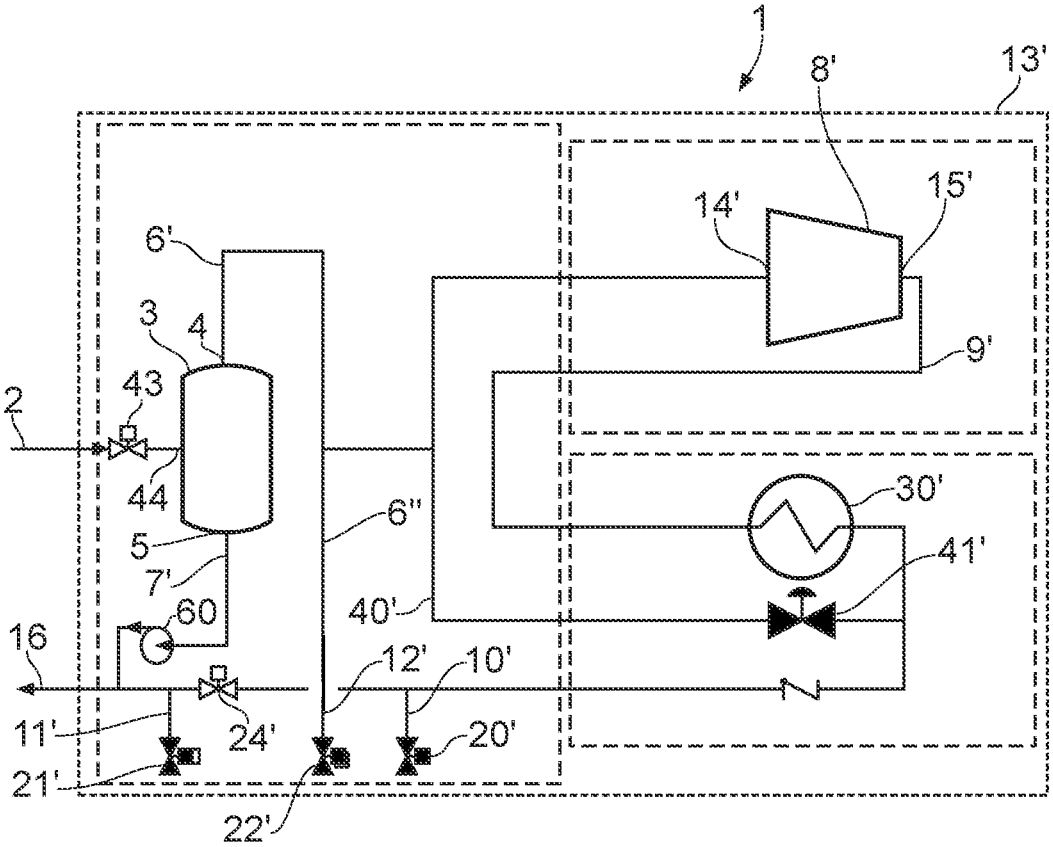
FIG. 8A shows an example where a pump is connected to an outlet for heavier fluids from the flow conditioning unit for pumping liquids separated in the flow conditioning unit directly out through the common outlet.

FIG. 8A shows an example where a pump 60 is connected to the outlet 5 for heavier fluids from flow conditioning unit 3 and the liquid entering the pump 60 is pumped out through the common outlet 16 of the system 1. The pump 60 may be an electric pump or can be operated by the gas in the system. In the latter, the pump 60 can for example be operated as disclosed in WO 2011051453 (Applicant: FMC Kongsberg AS).

Figure 8B:
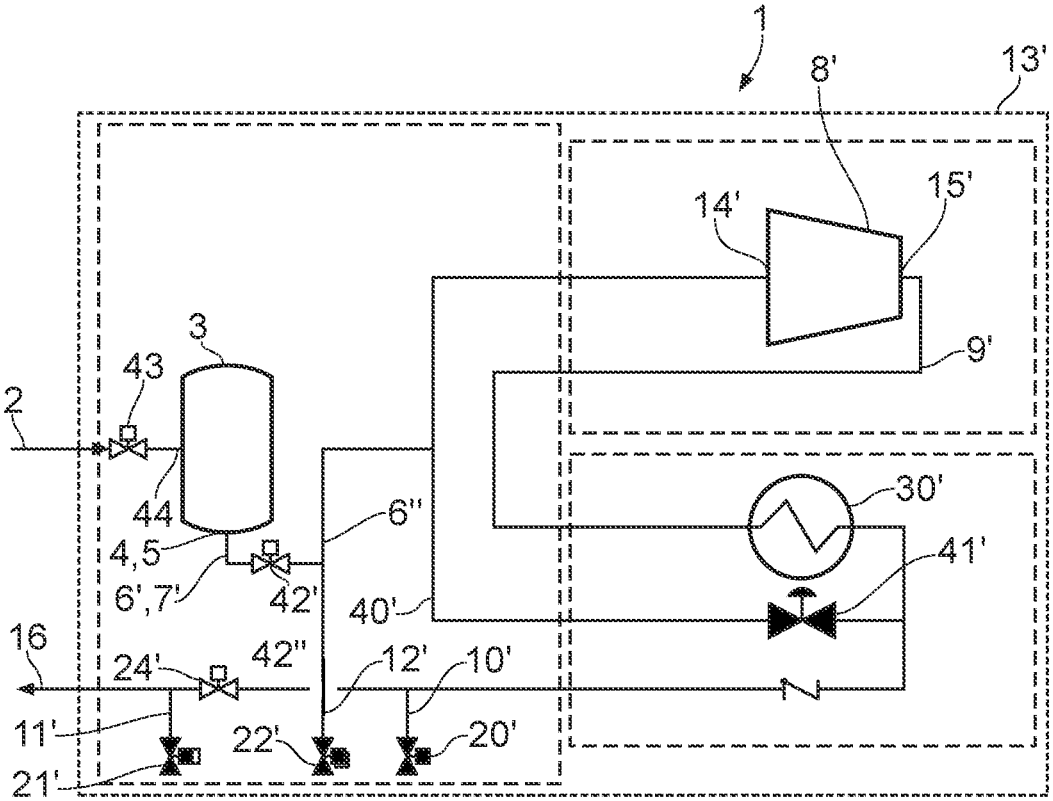
FIG. 8B shows an example with one sole outlet from the flow conditioning unit, and where lighter and heavier fluids are mixed inside the flow conditioning unit.

FIG. 8B shows an example with one sole outlet from the flow conditioning unit, and where lighter and heavier fluids are mixed inside the flow conditioning unit before exiting through the common sole outlet. A flow regulation device 42' can be arranged in the sole outlet, which flow regulation device can be operated to adjust the amount of mixed gas exiting the FCU and entering the compressor(s) 8'.

Figure 9A:
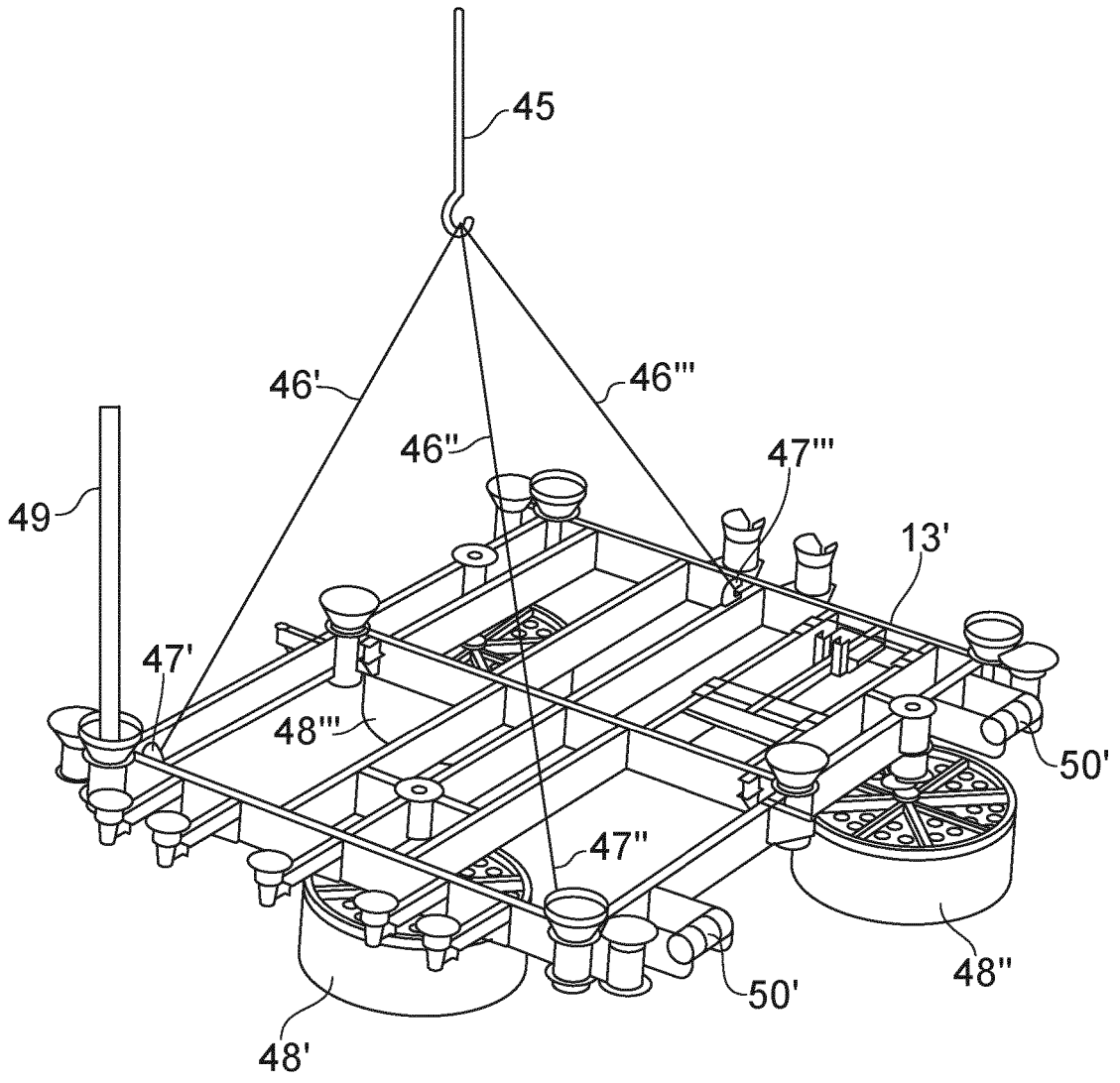
FIG. 9A shows an exemplary installation sequence for the first foundation structure.

FIG. 9A shows an exemplary installation sequence for the first foundation structure 13'. The first foundation structure 13' is lowered to the seabed using a wire 45. Three installation wires 46', 46", 46'" are connected to the wire 45 in one end and to wire connection points 47', 47", 47'" on the first foundation structure 13', respectively. When the first foundation structure 13' is positioned at the seabed (not shown), levelling of the first installation structure 13' may be performed using a foundation element in the form of mudmat(s) and/or piles. In the example of FIG. 9A three mudmats 48', 48", 48'" are shown. Once the first foundation structure 13' has been levelled, piling of the first foundation structure 13' to the seabed can be performed using one or more piles 49. The first foundation structure 13' comprises a connection interface 50' for connection to a second foundation structure (see FIG. 9B). The connection interface 50' in FIG. 9A is in the form of a connection enabling a pivotally connection to the second foundation structure.

Figure 9B:
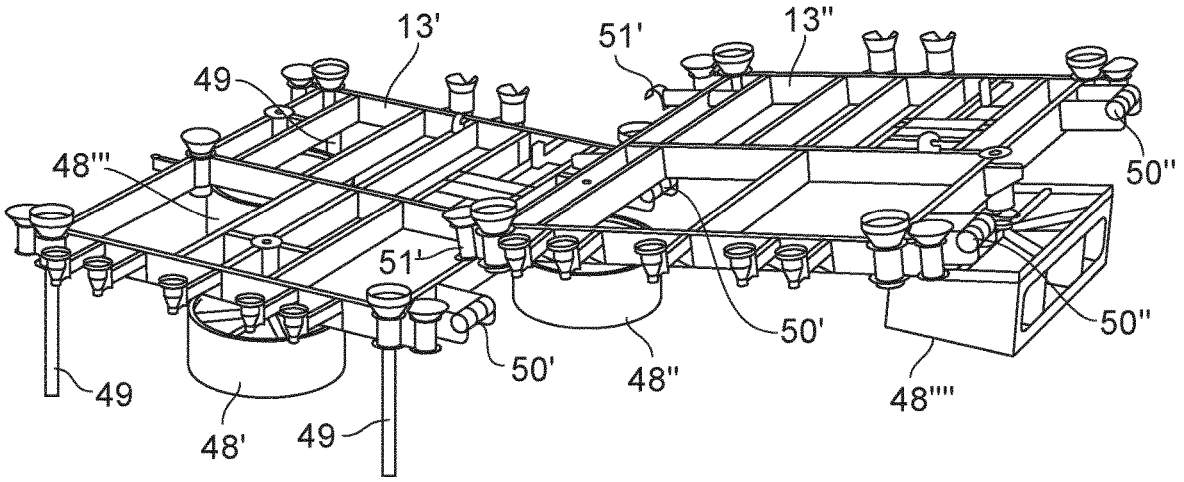
FIG. 9B shows an exemplary installation sequence for the second foundation structure to the first foundation structure.

FIG. 9B shows an exemplary installation sequence for the second foundation structure 13" to the first foundation structure 13'. Any consecutive foundation structures (not shown) have the same interfaces for connection to the previous foundation structure and to any consecutive foundation structures. The first foundation structure 13' has been installed on the seabed. The second foundation structure 13" is hung off on the first foundation structure 13' by a complementary connection interface 51' on the second foundation structure 13" which mates with the connection interface 50' of the first foundation structure 13'. When connected, the connection interface 50' and the complementary connection interface 51' form a pivot connection between the first and second foundation structures 13', 13" such that the second foundation structure 13" can be pivoted relative the first foundation structure 13' and which supports the second foundation structure 13" when positioned on the seabed. When the second foundation structure 13" is positioned on the seabed, levelling can be performed using one or more mudmats 48"". If further support is required after levelling, piling of the second foundation structure 13" to the seabed can be performed using one or more piles 49 (not shown in FIG. 9B, see FIG. 9A). The second foundation structure 13" comprises a connection interface 50" for connection to a third foundation structure (not shown).

Figure 9C:
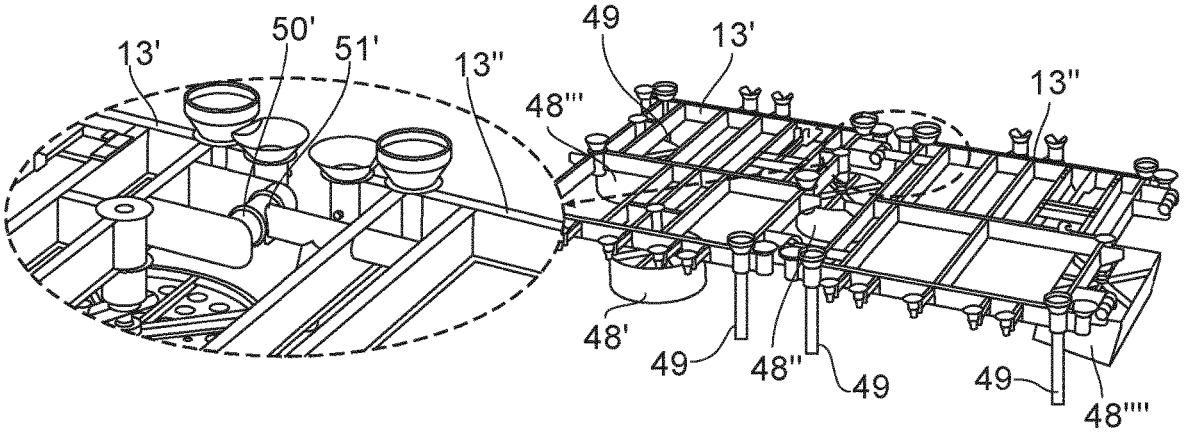
FIG. 9C shows an example of the connection between two consecutive foundation structures.

FIG. 9C shows an example of the connection between two consecutive foundation structures, i.e. the connection formed between the connection interface 50', 50" of a nth foundation structure 13', 13", 13'" and a complementary connection interface 51', 51" of a n+1 foundation structure 13", 13". For the ease of explanation of the Figure, the reference numerals in FIG. 9C identify the connection between the first and second foundation structures 13',13", however the connection will be similar between the second and third foundation structure and between the third and fourth foundation structure, . . . , etc.

Figure 10A:
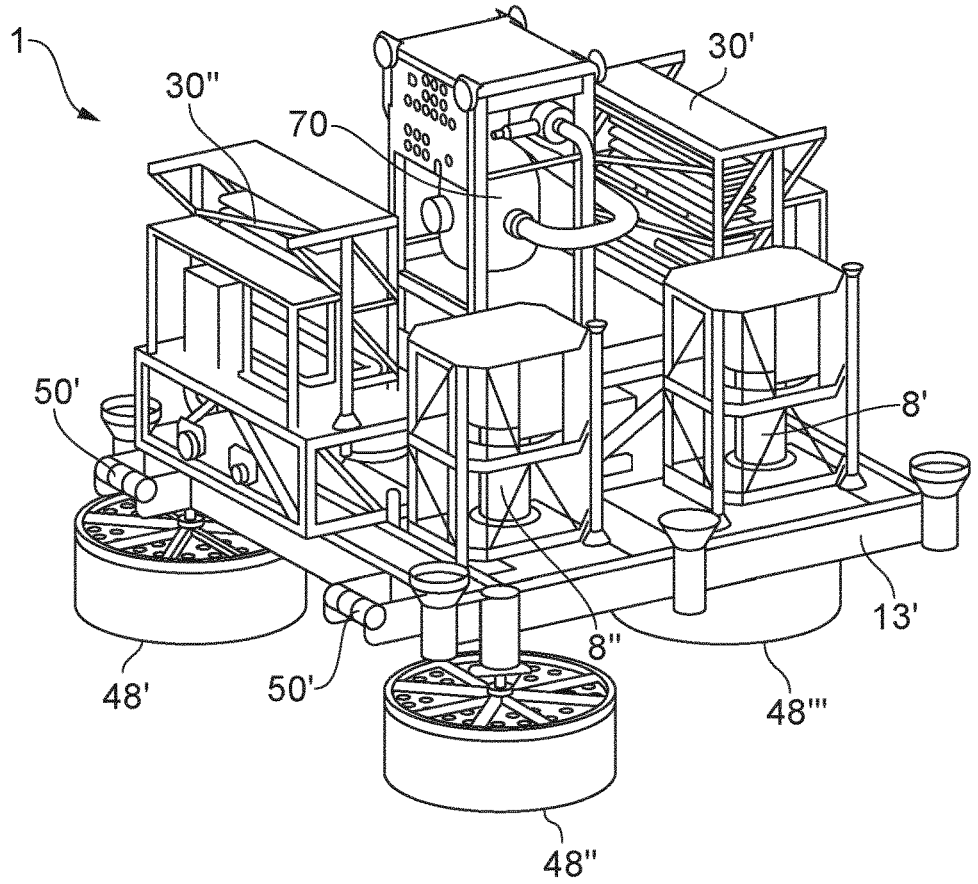
FIG. 10A is a perspective view of a subsea system comprising a first foundation structure installed subsea with a first compressor train and a second compressor train installed thereon.

FIG. 10A is a perspective view of a subsea system 1 comprising a first foundation structure 13' installed subsea with a first compressor train 8' and a second compressor train 8" installed thereon. The first and second compressor trains 8',8" share a common manifold 70. The features of the first foundation structure 13' are similar to the embodiment disclosed in FIG. 9A.

Figure 10B:
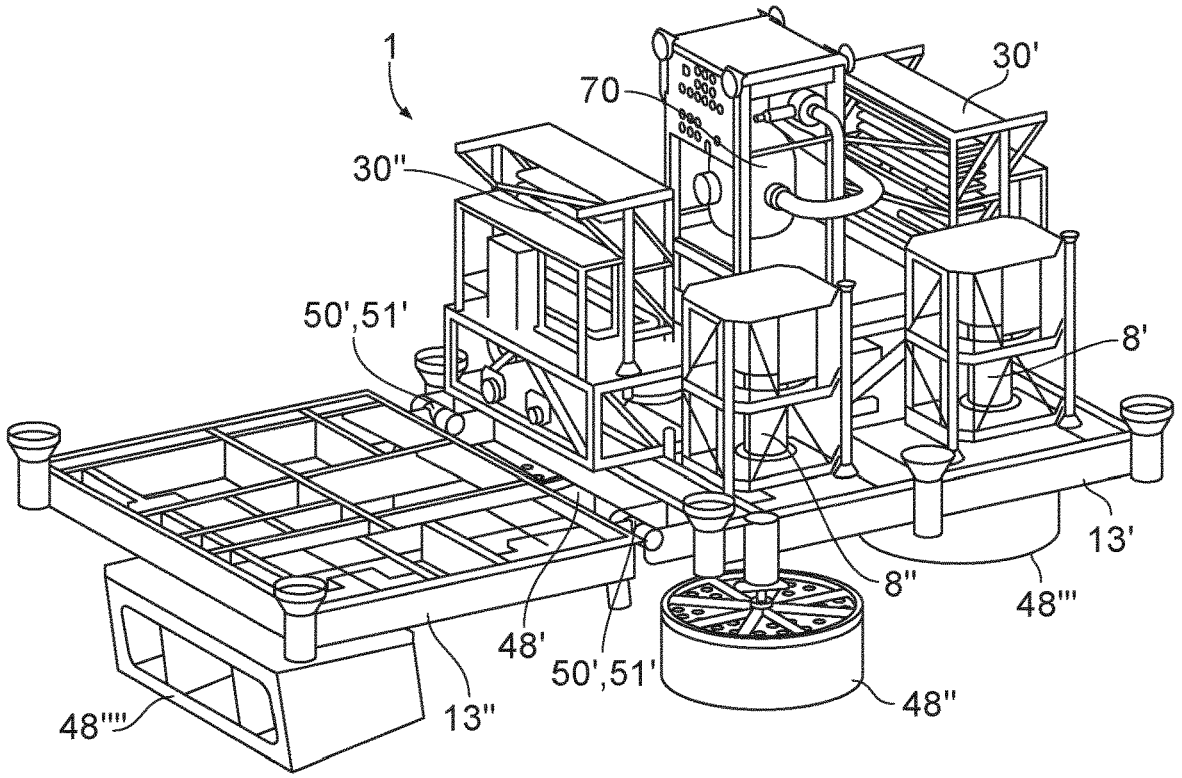
FIG. 10B is a perspective view of the subsea system of FIG. 10A, as well as a second foundation structure connected to the first foundation structure.

FIG. 10B is a perspective view of the subsea system 1 of FIG. 10A, as well as a second foundation structure 13" connected to the first foundation structure 13' via connection interfaces 50' on the first foundation structure 13' and complementary connection interfaces 51' on the second foundation structure 13". The second foundation structure 13" comprises a mudmat 48"" in the end facing away from the connection to the first foundation structure 13'. The second foundation structure 13" is shown without any equipment mounted thereon.

Figure 10C:
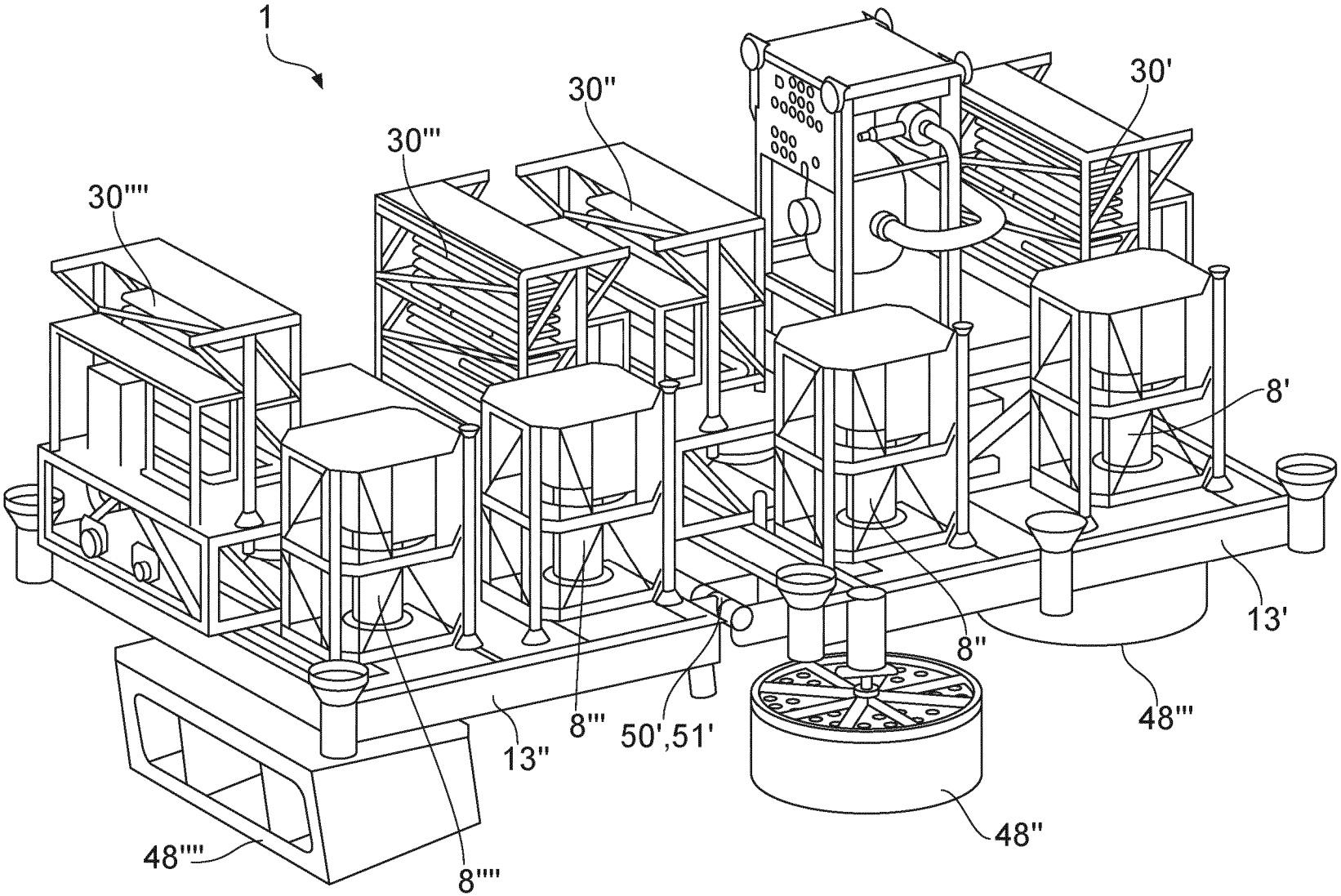
FIG. 10C is a perspective view of the subsea system of FIGS. 10A and 10B and a second foundation structure connected to the first foundation structure and where a third compressor train and a fourth compressor train are installed on the second foundation structure.

FIG. 10C is a is a perspective view of the subsea system 1 of FIGS. 10A and 10B and a second foundation structure 13" connected to the first foundation structure 13' and where a third compressor train 8'" and a fourth compressor train 8"" are installed on the second foundation structure 13". Each of the compressor trains 8',8",8'",8"" on the first and second foundation structures 13',13" are connected to a cooler 30',30",30'",30"", respectively. The features of the first foundation structure 13' and the second foundation structure 13" of FIGS. 10B and 10C are similar to the embodiment disclosed on FIGS. 9B and 9C.

The invention is now explained with reference to non-limiting embodiments. However, a skilled person will understand that there may be made alternations and modifications to the embodiment that are within the scope of the invention as defined in the attached claims. For example, if the well flow is mainly liquid, pump trains may be set up in a similar manner as the compressor trains as described herein.

| List of references: | |
|---|---|
| 1 | Subsea system |
| 2 | Well flow line |
| 3 | Flow conditioning unit (FCU)/ slug catcher/ separator |
| 4 | First outlet (FCU) / Light fluid outlet |
| 5 | Second outlet (FCU) / Heavy fluid outlet |
| 6' | Fluid line/ light fluid line between light fluid outlet and first compressor |
| 6" | Fluid line/ light fluid line between light fluid outlet and second compressor |
| 6'" | Fluid line/ light fluid line between outlet and third compressor |
| 7' | Fluid line/ heavy fluid line between heavy fluid outlet and first compressor |
| 7" | Fluid line/ heavy fluid line between heavy fluid outlet and second compressor |
| 8', 8", 8'" | First compressor |
| 8" | Second compressor |
| 8'" | Third compressor |
| 9' | First, second, third compressed fluid line |
| 9" | Second compressed fluid line |
| 9'" | Third compressed fluid line |
| 10' | First connection line between first compressor train and second compressor train |
| 10" | First connection line between second compressor train and third compressor train |
| 10'" | First connection line between third compressor train and fourth compressor train |

-continued

| List of references: | |
|---|---|
| 11' | Second connection line between first compressor train and second compressor train |
| 11" | Second connection line between second compressor train and third compressor train |
| 11"' | Second connection line between third compressor train and fourth compressor train |
| 12' | Third connection line between first compressor train and second compressor train |
| 12" | Third connection line between first compressor train and third compressor train |
| 12"' | Third connection line between first compressor train and fourth compressor train |
| 13' | First foundation structure |
| 13" | Second foundation structure |
| 13"' | Third foundation structure |
| 14' | Inlet first compressor |
| 14" | Inlet second compressor |
| 14"' | Inlet third compressor |
| 15' | Outlet first compressor |
| 15" | Outlet second compressor |
| 15"' | Outlet third compressor |
| 16 | Common outlet for the compressed fluid in the subsea system |
| 17', 17", 17"', 17"' | Foundation elements first foundation structure |
| 18', 18" | Foundation elements second foundation structure |
| 19', 19" | First and second variable speed drive (VSD) |
| 20' | Flow regulation device in first connection line between first and second compressor trains |
| 20" | Flow regulation device in first connection line between second and third compressor trains |
| 20" | Flow regulation device in first connection line between third and fourth compressor trains |
| 21' | Flow regulation device in second connection line between first and second compressor trains |
| 21" | Flow regulation device in second connection line between second and third compressor trains |
| 21"' | Flow regulation device in second connection line between third and fourth compressor trains |
| 22' | Flow regulation device in third connection line between first and second compressor trains |
| 22" | Flow regulation device in third connection line between first and third compressor trains |
| 22"' | Flow regulation device in third connection line between first and fourth compressor trains |
| 23 | Transformator (Trafo) |
| 24' | Flow regulation device in first compressed fluid line |
| 24" | Flow regulation device in second compressed fluid line |
| 24"' | Flow regulation device in third compressed fluid line |
| 25' | Flow regulation device in inlet line to second compressor |
| 25" | Flow regulation device in inlet line to third compressor |
| 26 | Electric cable |
| 27', 27" | Required pipes for each compressor train |
| 28' | Flow regulation device in inlet line to second compressor |
| 29' | Flow regulation device in heavy fluid line |
| 29" | Flow regulation device in heavy fluid line |
| 30', 30", 30" | First, second, third cooler |
| 40', 40", 40"' | First, second, third recycle line |
| 41', 41', 41"' | First, second, third anti-surge valve in recycle lines |
| 42' | Flow regulation device between second outlet of FCU and first compressor |
| 42" | Flow regulation device between second outlet of FCU and second compressor |
| 43 | Flow regulation device in well flow line upstream FCU |
| 44 | Inlet FCU |
| 45 | Wire |
| 46', 46", 46"' | Installation wires |
| 47', 47", 47"' | Wire connection points |
| 48', 48", 48"', 48"" | Mudmat(s) |
| 49 | pile |
| 50' | Connection interface on first foundation structure |
| 50" | Connection interface on second foundation structure |
| 51', 51" | Complementary connection interface |
| 60 | Pump |
| 70 | manifold |
| A | First subsea component (prior art) |
| B | Second subsea component (prior art) |
| C | Spool with liquid trap |

The invention claimed is:

1. A method of installing a subsea system comprising the steps of:

installing at least one first foundation structure on a seabed, wherein the first foundation structure comprises a connection interface configured to connect to a second foundation structure which is configured to at least partly support an additional compressor train on the seabed, and wherein the additional compressor train increases the subsea system capacity;

installing a first compressor train on the first foundation structure, the first compressor train comprising at least a first compressor;

connecting the first compressor train to at least one well flow line, the first compressor train comprising a fluid line connected to an inlet of the first compressor;

connecting a first compressed fluid line to an outlet of the first compressor and to a common outlet for the compressed fluid in the subsea system, wherein the first compressed fluid line comprises a flow regulation device;

connecting a first connection line to the first compressed fluid line at a position upstream of the flow regulating device and/or connecting a third connection line to the fluid line at a position upstream of the first compressor, wherein each of the first and third connection lines is configured to connect to the additional compressor train supported at least partly on the second foundation structure, and wherein each of the first and third connection lines comprises a corresponding flow regulation device; and connecting a second connection line to the first compressed fluid line at a position downstream of the flow regulation device, wherein the second connection line is configured to connect to the additional compressor train positioned at least partly on the second foundation structure, the additional compressor train thereby being connectable to the common outlet, and wherein the second connection line comprises a flow regulation device.

2. The method according to claim 1, further comprising the step of:

connecting a flow conditioning unit to the at least one well flow line upstream of the first compressor.

3. The method according to claim 1, further comprising the step of:

connecting a first cooler upstream of the first compressor and/or connecting a second cooler downstream of the first compressor.

4. The method according to claim 1, further comprising the step of:

starting up production using at least the first compressor train.

5. The method according to claim 4, further comprising the step of:

determining a need for increased compression capacity.

6. The method according to claim 1, further comprising the steps of:

installing the second foundation structure for supporting the additional compressor train on the seabed;

connecting the second foundation structure to the first foundation structure via the connection interface on the first foundation structure and a complementary connection interface on the second foundation structure, the first and second foundation structures thereby forming a common foundation structure;

installing the additional compressor train on the common foundation structure such that the additional compressor train is supported partly by the first and second foundation structures; and connecting the additional compressor train to the first compressor train via the second connection line and at least one of the first and third connection lines to thereby connect the additional compressor train to the common outlet, wherein the additional compressor train comprises an additional compressor.

7. The method according to claim 6, wherein the method further comprises moving or skidding components forming part of the subsea system into position relative each other on the common foundation structure.

8. The method according to claim 6, further comprising:

connecting the connection interface and the complementary connection interface to form a pivot connection between the first and second foundation structures such that the second foundation structure can be pivoted relative the first foundation structure, wherein the pivot connection supports the second foundation structure when positioned on the seabed.

9. The method according to claim 1, further comprising installing a second compressor train on the first foundation structure.

10. A subsea system comprising:

a first foundation structure configured to be installed on a seabed, the first foundation structure comprising a connection interface configured to connect to a second foundation structure which is configured to at least partly support an additional compressor train on the seabed, wherein the additional compressor train increases the subsea system capacity;

a first compressor train supported by the first foundation structure, the first compressor train comprising a first compressor with an inlet which is connectable via a fluid line to a well flow line;

a compressed fluid line connected to an outlet of the first compressor and to a common outlet for compressed fluid in the subsea system, wherein the compressed fluid line comprises a flow regulation device;

at least one of a first connection line connected to the compressed fluid line at a position upstream of the flow regulation device and a third connection line connected to the fluid line at a position upstream of the first compressor, wherein each of the first and third connection lines is configured to connect to the additional compressor train supported at least partly on the second foundation structure, and wherein each of the first and third connection lines comprises a corresponding flow regulation device; and a second connection line connected to the compressed fluid line at a position downstream of the flow regulation device, wherein the second connection line is configured to connect to the additional compressor train supported at least partly on the second foundation structure, the additional compressor train thereby being connectable to the common outlet, and wherein the second connection line comprises a flow regulation device.

11. The subsea system according to claim 10, wherein the first compressor train comprises a flow conditioning unit connected to the well flow line, and wherein the flow conditioning unit comprises at least a first outlet connectable to the inlet of the first compressor via the fluid line.

12. The subsea system according to claim 11, wherein the flow conditioning unit is shared by the first compressor train and any additional compressor train(s).

13. The subsea system according to claim 10, wherein the system comprises a first cooler positioned upstream of the first compressor and/or a second cooler positioned downstream of the first compressor.

14. The subsea system according to claim 10, further comprising:

a second foundation structure configured to be installed on the seabed, the second foundation structure being connected to the first foundation structure via the connection interface and a complementary connection interface on the second foundation structure, the first and second foundation structures thereby forming a common foundation structure positioned on the seabed; and an additional compressor train installed on the common foundation structure such that the additional compressor train is supported partly by the first and second foundation structures;

wherein the additional compressor train comprises an additional compressor, wherein the additional compressor comprises an inlet and an outlet, and wherein the inlet is connected to at least one of the first and third connection lines and the outlet is connected to a second compressed fluid line; and wherein the second compressed fluid line is connected to the common outlet via the second connection line.

15. The subsea system according to claim 14, wherein the additional compressor train comprises an additional cooler.

16. The subsea system according to claim 14, wherein at least some of the components forming part of the subsea system are movable or skiddable on the common foundation structure.

17. The subsea system according to claim 14, wherein the connection interface and the complementary connection interface form a pivot connection between the first and second foundation structures such that the second foundation structure can be pivoted relative the first foundation structure, wherein the pivot connection supports the second foundation structure when positioned on the seabed.

18. The subsea system according to claim 10, wherein the subsea system further comprises other equipment for operating components of the subsea system, wherein said other equipment is located at the same foundation structure as the compressor train the other equipment operates.

19. A subsea system comprising:

a first foundation structure configured to be installed on a seabed, the first foundation structure comprising a connection interface configured to connect to a second foundation structure which is configured to at least partly support an additional compressor train on the seabed, wherein the additional compressor train increases the subsea system capacity;

a first compressor train supported by the first foundation structure, the first compressor train comprising a first compressor with an inlet which is connectable via a fluid line to a well flow line;

a compressed fluid line connected to an outlet of the first compressor and to a common outlet for compressed fluid in the subsea system, wherein the compressed fluid line comprises a flow regulation device;

a first connection line connected to the compressed fluid line at a position upstream of the flow regulation device and a third connection line connected to the fluid line at a position upstream of the first compressor, wherein each of the first and third connection lines is configured to connect to the additional compressor train supported at least partly on the second foundation structure, and wherein each of the first and third connection lines comprises a corresponding flow regulation device; and a second connection line connected to the compressed fluid line at a position downstream of the flow regulation device, wherein the second connection line is configured to connect to the additional compressor train supported at least partly on the second foundation structure, the additional compressor train thereby being connectable to the common outlet, and wherein the second connection line comprises a flow regulation device.

* * * * *